US010518992B2

(12) United States Patent
Edo et al.

(10) Patent No.: US 10,518,992 B2
(45) Date of Patent: Dec. 31, 2019

(54) SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

(71) Applicants: Yousuke Edo, Kanagawa (JP); Hikaru Fukasawa, Kanagawa (JP); Hidetoshi Kojima, Kanagawa (JP)

(72) Inventors: Yousuke Edo, Kanagawa (JP); Hikaru Fukasawa, Kanagawa (JP); Hidetoshi Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/182,570

(22) Filed: Nov. 6, 2018

(65) Prior Publication Data

US 2019/0210821 A1 Jul. 11, 2019

(30) Foreign Application Priority Data

Jan. 5, 2018 (JP) ..... 2018-000824

(51) Int. Cl.

| | |
|---|---|
| ***B65H 1/18*** | (2006.01) |
| ***B65H 1/14*** | (2006.01) |
| ***B65H 3/14*** | (2006.01) |
| ***B65H 1/26*** | (2006.01) |
| ***B65H 3/48*** | (2006.01) |
| ***B65H 7/04*** | (2006.01) |
| ***B65H 1/04*** | (2006.01) |

(Continued)

(52) U.S. Cl.

CPC ..... *B65H 1/18* (2013.01); *B65H 1/04* (2013.01); *B65H 1/14* (2013.01); *B65H 1/26* (2013.01);

(Continued)

(58) Field of Classification Search

CPC ... B65H 7/04; B65H 7/02; B65H 7/14; B65H 43/02; B65H 43/08; B65H 1/14;

(Continued)

(56) References Cited

U.S. PATENT DOCUMENTS 6,102,389 A * 8/2000 Sakurai ..... B65H 3/5223 271/121
6,361,038 B1 * 3/2002 Tada ..... B65H 1/08 271/111

(Continued)

FOREIGN PATENT DOCUMENTS

JP 2008056446 A * 3/2008
JP 2015009926 A * 1/2015

(Continued)

*Primary Examiner* — Luis A Gonzalez
(74) *Attorney, Agent, or Firm* — Duft & Bornsen, PC

(57) ABSTRACT

A sheet conveying device includes a sheet loader, a loader elevating device, a sheet presence detector to detect a sheet on the sheet loader, and circuitry configured to determine whether the bundle of sheets is loaded on the sheet loader based on a detection result of the sheet presence detector and to control movement of the loader elevating device. The circuitry is configured to cause the loader elevating device to lift the sheet loader to a second position in response to a detection result of the sheet presence detector indicating absence of the sheet on the sheet loader at a first position and not to determine absence of the sheet when the circuitry causes the loader elevating device to lower the sheet loader from the second position to the first position after the circuitry causes the loader elevating device to lift the sheet loader to the second position.

16 Claims, 16 Drawing Sheets

(51) Int. Cl.
*B65H 43/02* (2006.01)
*B65H 43/08* (2006.01)

(52) U.S. Cl.
CPC ..... *B65H 3/14* (2013.01); *B65H 3/48* (2013.01); *B65H 7/04* (2013.01); *B65H 43/02* (2013.01); *B65H 43/08* (2013.01); *B65H 2405/15* (2013.01); *B65H 2511/20* (2013.01); *B65H 2511/515* (2013.01); *B65H 2513/40* (2013.01); *B65H 2553/80* (2013.01); *B65H 2801/03* (2013.01)

(58) Field of Classification Search
CPC ... B65H 1/18; B65H 3/14; B65H 3/48; B65H 2511/515
See application file for complete search history.

(56) References Cited

U.S. PATENT DOCUMENTS

| | | | | |
|---|---|---|---|---|
| 7,568,850 | B2 * | 8/2009 | Bingham | B41J 13/103 271/145 |
| 8,336,870 | B2 * | 12/2012 | Kobayashi | B65H 1/14 271/10.01 |
| 2014/0131938 | A1 | 5/2014 | Satoh et al. | |
| 2015/0166280 | A1 | 6/2015 | Hino et al. | |

FOREIGN PATENT DOCUMENTS

| | | |
|---|---|---|
| JP | 2016-088713 | 5/2016 |
| JP | 2016-124707 | 7/2016 |

* cited by examiner

SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2018-000824, filed on Jan. 5, 2018, in the Japan Patent Office, the entire disclosure of which is hereby incorporated by reference herein.

BACKGROUND

Technical Field

This disclosure relates to a sheet feeding device, an image forming apparatus incorporating the sheet feeding device, and an image forming system incorporating the sheet feeding device.

Related Art

Various types of sheet feeding devices are known to include a sheet loader on which a bundle of sheets or prepregs is loaded, a loader elevating device that moves the sheet loader upward and downward, and a controller to control movement of the loader elevating device.

For example, a known sheet feeding device includes a first position determiner (to detect sheets at a lower position below an upper end face sensor) and a second position determiner (to detect the sheets at an upper position above the upper end face sensor). When the first position determiner determines (detects) that a sheet loader (a sheet loading table) on which a sheet (an uppermost sheet of the sheet) is loaded is lifted to a first position (a first predetermined position), a sheet detector (a paper end sensor) determines (detects) whether the sheet is present or absent (not present) on the sheet loader. Then, when it is determined that the sheet is not present on the sheet loader, the sheet loader is lifted to a second position (a second predetermined position) that is a determining position of the second position determiner, so that the sheet detector detects whether the sheet is present or absent (not present) on the sheet loader again.

By detecting the presence or absence of the sheet as described above, even the presence or absence of a black sheet and a sheet having low reflectance are detected reliably.

SUMMARY

At least one aspect of this disclosure provides a sheet feeding device including a sheet loader, a loader elevating device, a sheet presence detector, a sheet presence determiner, and circuitry. A bundle of sheets is to be loaded on the sheet loader. The loader elevating device is configured to move the sheet loader in a vertical direction. The sheet presence detector is configured to detect whether the sheet is loaded on the sheet loader. The circuitry is configured to determine whether the sheet is loaded on the sheet loader based on a detection result of the sheet presence detector, and to control movement of the loader elevating device. The circuitry is configured to cause the loader elevating device to lift the sheet loader to a second position is above a first position in the vertical direction of the sheet loader, in response to a detection result of the sheet presence detector indicating that a sheet is absent on the sheet loader at the first position. The circuitry is configured not to determine that the sheet is absent on the sheet loader when the circuitry causes the loader elevating device to lower the sheet loader from the second position to the first position after the circuitry causes the loader elevating device to lift the sheet loader to the second position.

Further, at least one aspect of this disclosure provides an image forming apparatus including the above-described sheet feeding device configured to feed a sheet separated from the bundle of sheets, and an image forming device configured to form an image on the sheet fed by the sheet feeding device.

Further, at least one aspect of this disclosure provides an image forming system including the above-described sheet feeding device configured to feed a sheet separated from the bundle of sheets, and an image forming apparatus configured to form an image on the sheet fed by the sheet feeding device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
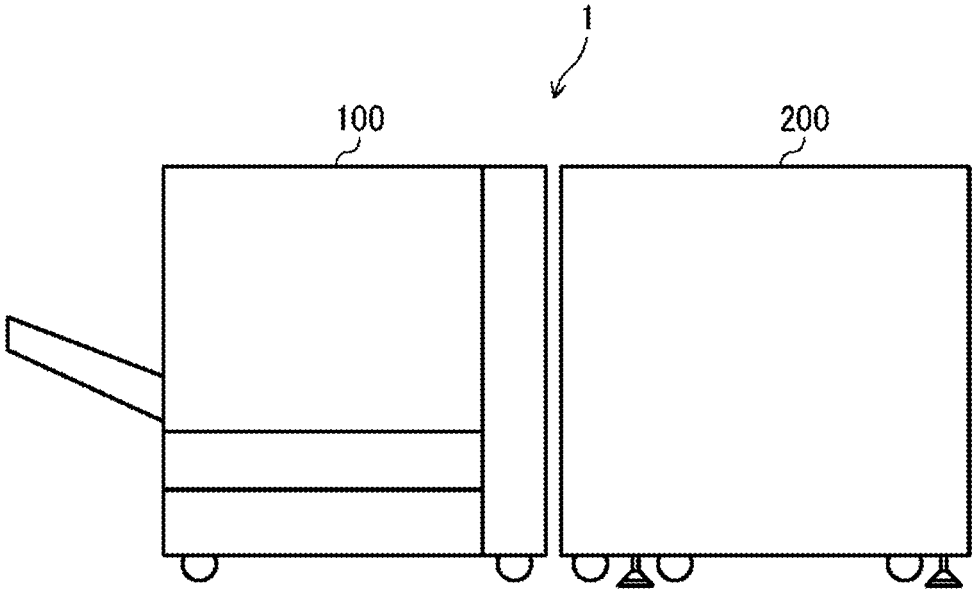
FIG. 1 is a diagram illustrating a schematic configuration of an image forming system according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a sheet feeding device according to an embodiment of this disclosure.

It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming system 1 according to an embodiment of this disclosure.

As illustrated in FIG. 1, the image forming system 1 includes an electrophotographic image forming apparatus 100 that functions as an image forming apparatus to form an image on a sheet and a sheet feeding device 200 that functions as a sheet feeding device to feed the sheet to the image forming apparatus 100. The sheet feeding device 200 is disposed on a side face of an apparatus body of the image forming apparatus 100.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

A description is given of an entire configuration and operations of the image forming apparatus 100 according to an embodiment of this disclosure. The image forming apparatus 100 corresponds to a printer to which the sheet feeding device 200 is applied, and to a copier that has an image forming function similar to the printer.

Figure 2:
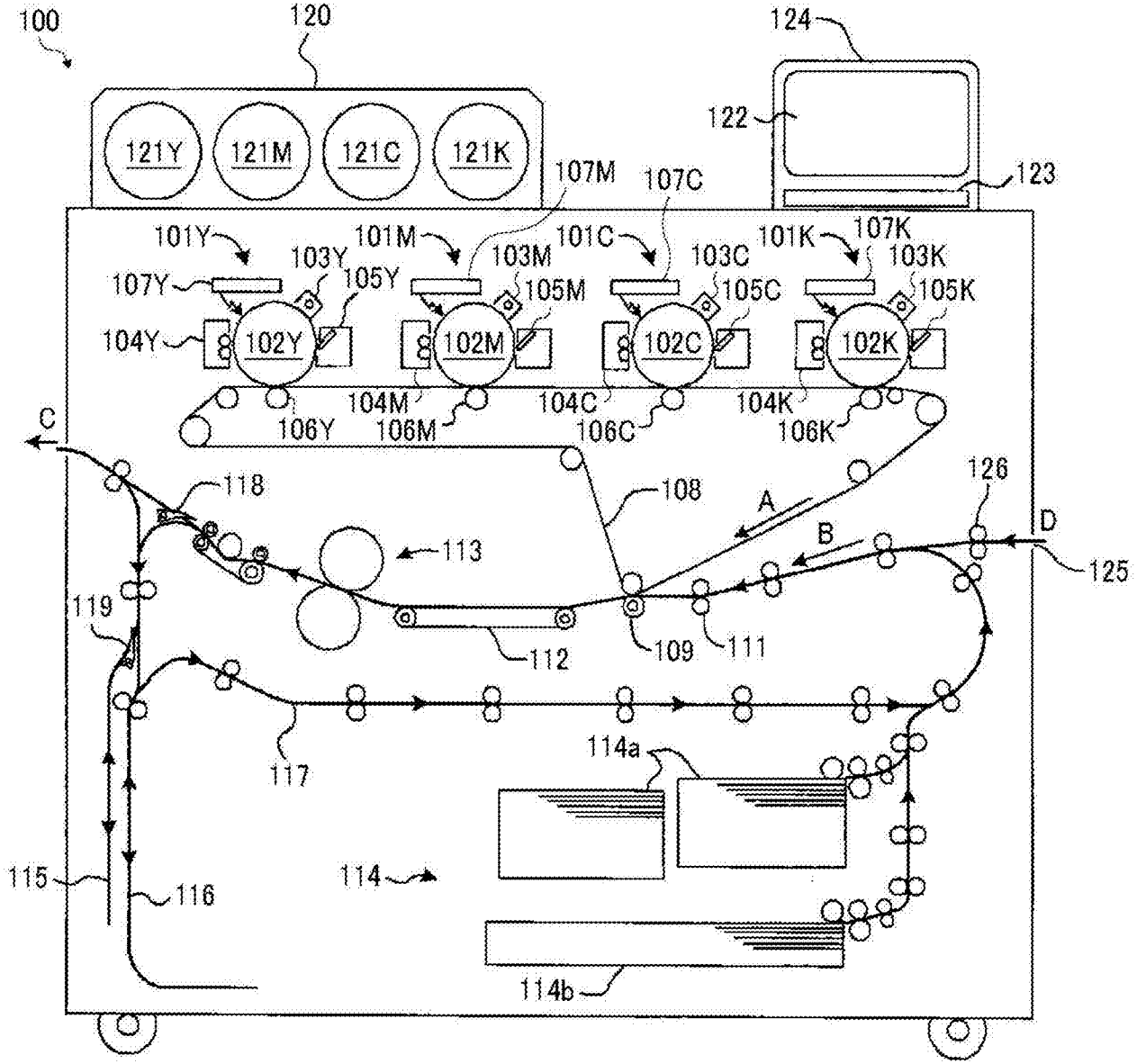
FIG. 2 is a diagram illustrating a schematic configuration of an image forming apparatus according to an embodiment of this disclosure.

FIG. 2 is a schematic diagram illustrating the image forming apparatus 100 according to the present embodiment of this disclosure.

The image forming apparatus 100 has printing functions for forming a full color image with four color toners such as yellow (Y), cyan (C), magenta (M), and black (K). As illustrated in FIG. 2, the image forming apparatus 100 includes four image forming units 101Y, 101M, 101C and 101K. The image forming units 101Y, 101M, 101C and 101K that form respective single color images are aligned at an upper part of the apparatus body of the image forming apparatus 100.

The image forming units 101Y, 101M, 101C and 101K have a substantially identical configuration and functions to each other. Therefore, the following details of the image forming units 101Y, 101M, 101C and 101K are described as a single image forming unit that corresponds to each of the image forming units 101Y, 101M, 101C and 101K, without the suffixes Y, M, C and K indicating respective colors. The image forming unit 101 (i.e., the image forming units 101Y, 101M, 101C and 101K) includes a photoconductor drum 102 (i.e., photoconductor drums 102Y, 102M, 102C and 102K) that functions as an image bearer, a charging device 103 (i.e., charging devices 103Y, 103M, 103C and 103K), a developing device 104 (i.e., developing devices 104Y, 104M, 104C and 104K), and a cleaning device 105 (i.e., cleaning devices 105Y, 105M, 105C and 105K). The charging device 103, the developing device 104, and the cleaning device 105 are disposed around the photoconductor drum 102. Further, an optical writing device 107 is disposed above the photoconductor drum 102.

An intermediate transfer belt 108 is disposed below the image forming units 101Y, 101M, 101C and 101K. The intermediate transfer belt 108 is wound around multiple support rollers. As one of the multiple support rollers is driven by a drive unit, the intermediate transfer belt 108 is rotated in a direction indicated by arrow A in FIG. 1.

A transfer roller 106 (i.e., transfer rollers 106Y, 106M, 106C and 106K) that functions as a primary transfer unit is disposed facing the photoconductor drum 102 of the image forming unit 101 with the intermediate transfer belt 108 interposed therebetween. When the transfer roller 106 and the photoconductor drum 102 contact to each other with the intermediate transfer belt 108 interposed therebetween, a primary transfer portion is formed to primarily transfer the toner image onto the photoconductor drum 102.

In the image forming unit 101, the photoconductor drum 102 is rotated in a counterclockwise direction in FIG. 1. Then, the charging device 103 uniformly charges the surface of the photoconductor drum 102 to a predetermined polarity. Then, an optically modulated laser light beam is emitted from the optical writing device 107 to the charged surface of the photoconductor drum 102, so that an electrostatic latent image is formed on the charged surface of the photoconductor drum 102. The electrostatic latent image formed on the photoconductor drum 102 is developed with toner applied by the developing device 104 into a visible toner image. The visible toner images of respective single colors (i.e., yellow, cyan, magenta, and black) formed by the image forming units 101Y, 101M, 101C, and 101K are sequentially transferred in layers onto the surface of the intermediate transfer belt 108.

The image forming apparatus 100 further includes a sheet feeding unit 114 in the lower part of the apparatus body. The sheet feeding unit 114 includes a sheet tray 114*a* and a sheet tray 114*b*. A sheet is fed from one of the sheet feeding unit 114 and the sheet feeding device 200 that is connected to the image forming apparatus 100. The sheet fed from one of the sheet feeding unit 114 and the sheet feeding device 200 is conveyed to a pair of registration rollers 111 in a direction indicated by arrow B in FIG. 1.

After contacting and being temporarily stopped at the pair of registration rollers 111, the sheet is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the composite toner image (the full color image) formed on the surface of the intermediate transfer belt 108 is transferred onto the sheet. After the toner image has been transferred onto the sheet, the sheet is conveyed by a sheet conveying belt 112 to a fixing device 113. In the fixing device 113, the toner image is fixed to the sheet by application of heat and pressure. After the toner image is fixed to the sheet, the sheet is output from of the apparatus body of the image forming apparatus 100 in a direction indicated by arrow C in FIG. 2 and is stacked on a sheet output tray.

It is to be noted that, when the sheet is ejected with the back of the sheet facing up in the single-side printing (a face down ejection), the front face and the back face of the sheet are reversed by ejecting the sheet outside the apparatus body of the image forming apparatus 100 in the direction indicated by arrow C in FIG. 1 via a sheet reverse portion 115.

Further, when performing a duplex printing operation, after the toner image has been fixed to the sheet, the sheet is conveyed via a duplex reverse portion 116 from a reentry passage 117 toward the pair of registration rollers 111 again. By so doing, a toner image formed on the surface of the intermediate transfer belt 108 is transferred onto the back face of the sheet. After the toner image has been transferred onto the sheet, the toner image is fixed to the sheet in the fixing device 113. Then, similar to the single-side printing operation, the sheet is ejected out in the direction C in FIG. 1 directly from the fixing device 113 or via the sheet reverse portion 115 and is stacked on the sheet output tray.

In addition, switching claws 118 and 119 are disposed appropriately on a sheet conveyance passage to switch a sheet conveying direction.

When performing a monochrome printing operation, the image forming apparatus 100 according to the present embodiment uses the image forming unit 101K alone to form a monochrome toner image and transfers the monochrome toner image onto a sheet via the intermediate transfer belt 108. A sheet having a monochrome toner image on the surface is handled by the same process as a sheet having a full color toner image after the toner image is fixed to the sheet.

It is to be noted that a toner bottle set 120 in which toner bottles 121Y, 121M, 121C, and 121K is disposed on an upper face of the apparatus body of the image forming apparatus 100. The toner bottle (i.e., the toner bottles 121Y, 121M, 121C, and 121K) contains toner to be supplied to the developing device 104 (i.e., the developing devices 104Y, 104M, 104C, and 104K) of the image forming unit 101 (i.e., the image forming units 101Y, 101M, 101C, and 101K).

The image forming apparatus 100 further includes a control unit 124 that includes a display 122 and a control panel 123. The control unit 124 is also disposed on the upper face of the apparatus body of the image forming apparatus 100.

In addition, a sheet entrance D is provided on the right side face of the apparatus body of the image forming apparatus 100 in FIG. 2. A sheet conveyed from the sheet feeding device 200 (see FIG. 3) comes into the apparatus body of the image forming apparatus 100 through the sheet entrance D. A bypass tray opening 125 and a pair of bypass rollers 126 are provided are provided at the sheet entrance D. The sheet is received through the bypass tray opening 125 and then is conveyed by the pair of bypass rollers 126.

Figure 3:
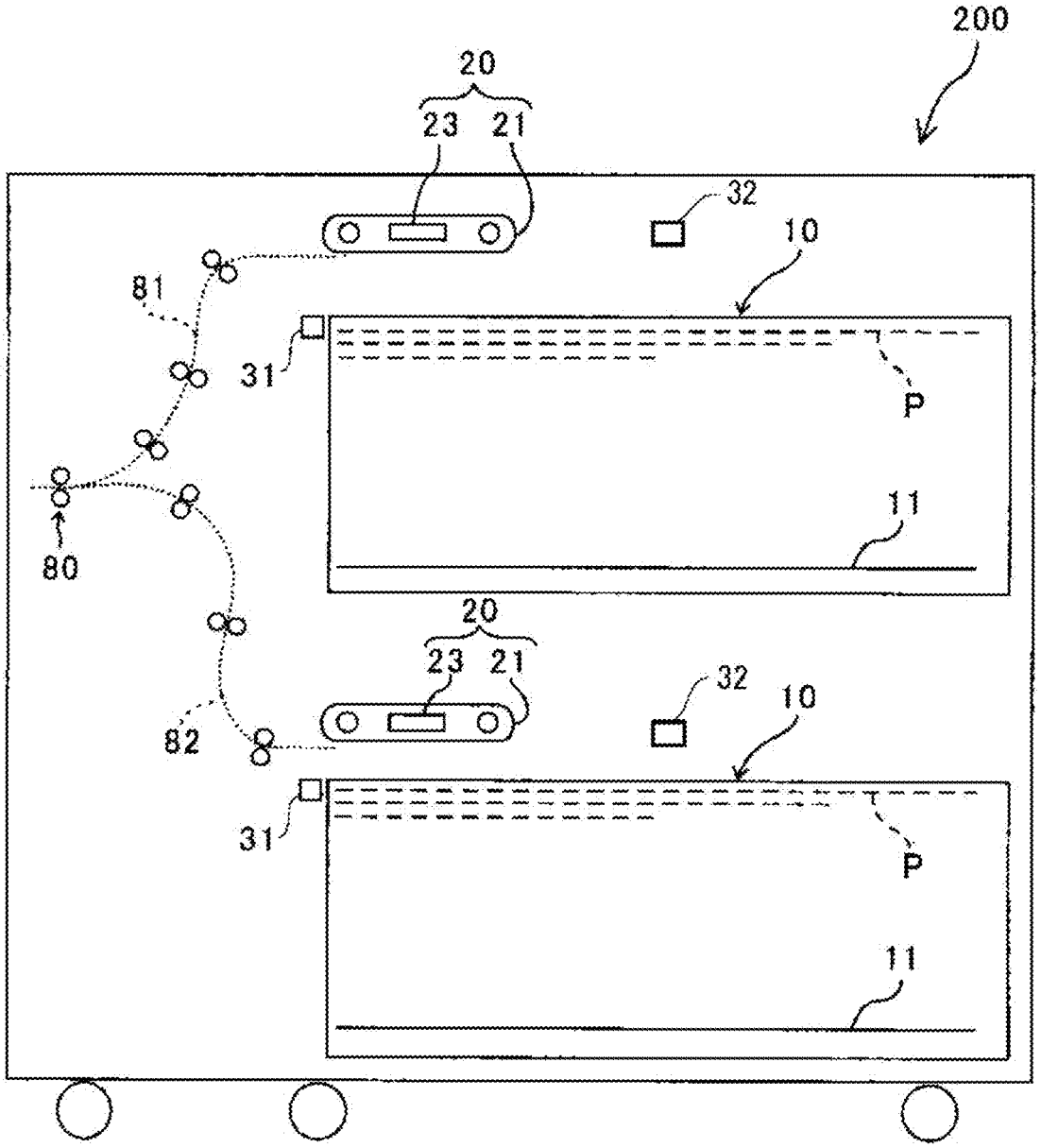
FIG. 3 is a diagram illustrating a schematic configuration of a sheet feeding device according to an embodiment of this disclosure.

FIG. 3 is a diagram illustrating the sheet feeding device 200 according to an embodiment of this disclosure.

The sheet feeding device 200 includes two sheet trays 10 disposed vertically to each other (i.e., a lower sheet tray 10 and an upper sheet tray 10). Each of the sheet trays 10 includes a sheet loading device 11 that functions as a sheet loader on which a bundle of sheets P is loaded. In the present embodiment, each of the sheet trays 10 is capable of containing sheet up to about 2500 sheets.

A sheet attracting and conveying unit 20 is disposed above each of the sheet trays 10. The sheet attracting and conveying unit 20 attracts a sheet, separates the sheet from other sheets in the bundle of sheets P loaded on the sheet tray 10, and feeds the sheet P from the sheet tray 10. The sheet attracting and conveying unit 20 includes an attraction belt 21 that functions as a conveying body and an air drawing device 23. In other words, the sheet feeding device 200 is an air (vacuum) pick-up feeding device.

Further, each of the sheet trays 10 includes a sheet detection sensor 31 and a paper end sensor 32. The sheet detection sensor 31 includes two reflective optical sensors on the same face of the sheet tray 10 to detect an upper side portion of multiple sheets P of the bundle of sheets loaded on the sheet loading device 11. The paper end sensor 32 detects whether the sheet P is loaded on the sheet loading device 11, in other words, the sheet is present or absent (not present) on the sheet loading device 11. In addition, the respective sheet trays 10 perform a control to lift and lower the sheet loading device 11 according to the output values of the reflective optical sensors.

The sheet detection sensor 31 includes a first upper end face sensor 31*a* and a second upper end face sensor 31*b*. Details of the first upper end face sensor 31*a* and the second upper end face sensor 31*b* are described below.

Each sheet P loaded on the sheet tray 10 at the lower portion of the apparatus body of the image forming apparatus 100 (i.e., the lower sheet tray 10) passes through a lower conveyance passage 82 and is conveyed by a pair of outlet rollers 80 to the apparatus body of the image forming apparatus 100. By contrast, each sheet P loaded on the sheet tray 10 at the upper portion of the apparatus body of the image forming apparatus 100 (i.e., the upper sheet tray 10) passes through an upper conveyance passage 81 and is conveyed by the pair of outlet rollers 80 to the apparatus body of the image forming apparatus 100.

Figure 4:
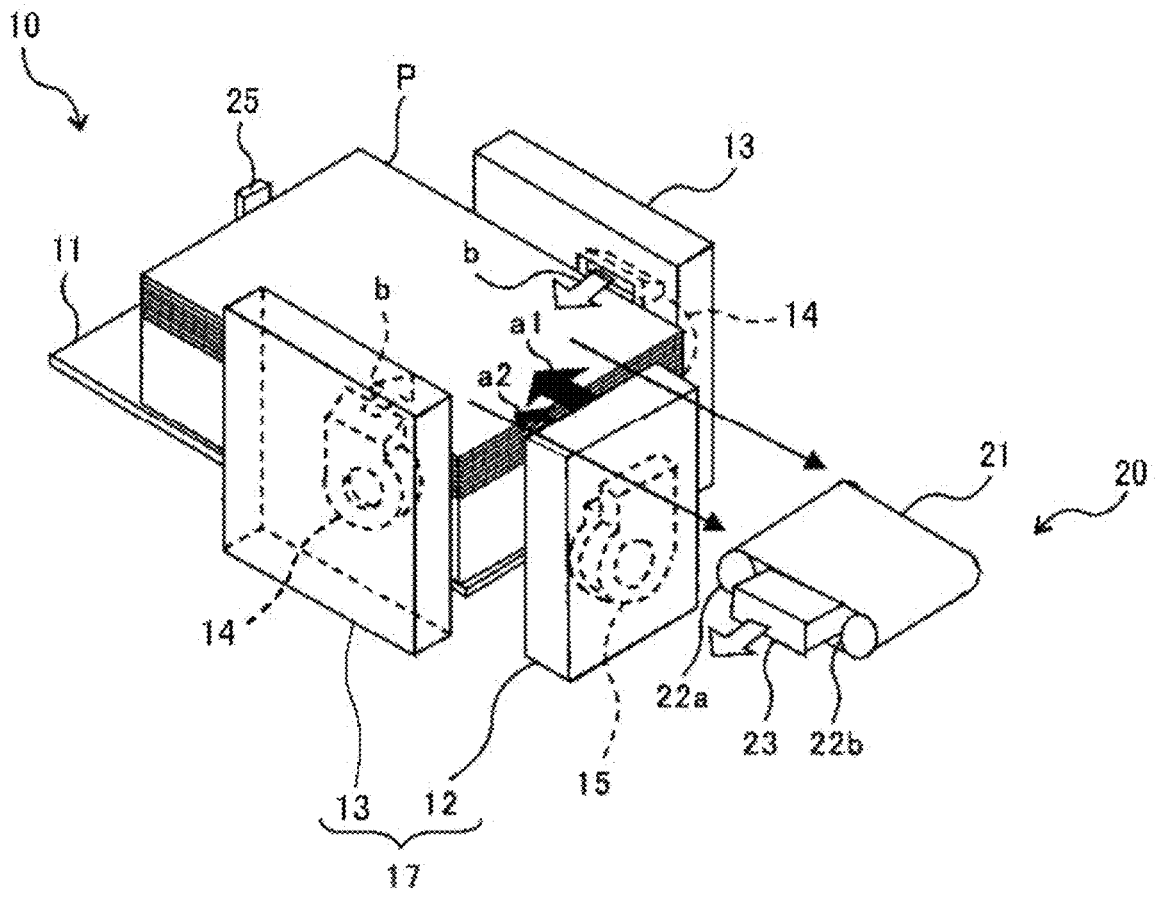
FIG. 4 is a perspective view illustrating a sheet tray included in the sheet feeding device.

FIG. 4 is a perspective view illustrating one of the sheet trays 10 included in the sheet feeding device 200.

The attraction belt 21 of the sheet attracting and conveying unit 20 is stretched by two tension rollers 22*a* and 22*b* and includes multiple air drawing openings over an entire region in a circumferential direction. The multiple air drawing openings penetrate through the attraction belt 21 from the front face side to the back face side. The air drawing device 23 is disposed inside an inner loop of the attraction belt 21. The air drawing device 23 is coupled with an air drawing fan that intakes air via an air duct that functions as an air flowing passage. As the air drawing device 23 generates a negative pressure in a lower area, the sheet P is attracted to a lower face of the attraction belt 21.

Further, each sheet tray 10 includes an air blowing device 17 that functions as an air blower to blow air toward the sheets P on the upper portion of the bundle of sheets P. The air blowing device 17 includes a front air blowing device 12 and side air blowing devices 13.

The front air blowing device 12 blows air toward the leading end of the sheets P on the upper portion of the bundle of sheets P (i.e., a downstream side end of the bundle of sheets P in the sheet conveying direction). The front air blowing device 12 includes a floating nozzle, a separation nozzle, and two air blowing fans 15. The floating nozzle guides air in a direction to float the sheets P on the upper portion of the bundle of sheets. The separation nozzle guides air in a direction to separate an uppermost floating sheet P and other floating sheet(s) P. The respective air blowing fans 15 blow air to the floating nozzle and the separation nozzle. Air that is blown from one of the air blowing fans 15 and the floating nozzle in a direction indicated by arrow "a1" in FIG. 4 is referred to as "floating air". Air that is blown from the other of the air blowing fans 15 and the separation nozzle in a direction indicated by arrow "a2" in FIG. 4 is referred to as "separating air". The floating air and the separation air are discharged from respective portions facing the leading end of the sheets P on the upper portion of the bundle of sheets (i.e., the downstream side end of the bundle of sheets P in the sheet conveying direction). Consequently, the floating air and the separation air are blown to the leading end of the sheets P on the upper portion of the bundle of sheets (i.e., the downstream side end of the bundle of sheets P in the sheet conveying direction).

The side air blowing devices 13 are mounted in pairs on one side of each of a pair of side fences. Each of the side air blowing devices 13 includes an air blowing fan 14 to blow air in a direction indicated by arrow "b" toward the side face of the upper portion of the bundle of sheets. Each of the side air blowing devices 13 includes a side floating nozzle that flips and separates the sheets P of the bundle of sheets and guides air to a direction to lift and float the sheets P. Air that is blown from the side floating nozzle in the direction indicated by arrow "b" in FIG. 4 is referred to as side air. The side air is discharged from an air discharging port that is provided at a portion of each of the side air blowing devices 13, facing the upper portion of the bundle of sheets. Consequently, the side air is discharged from the air discharging port and is blown to the side face of the upper portion of the bundle of sheets. Due to the air blown from the front air blowing device 12 and the air discharging port of the side air blowing devices 13, the sheets P on the upper portion of the bundle of sheets are lifted to float.

Further, each sheet tray 10 includes an end fence 25 to align the trailing end of the bundle of sheets loaded on the sheet loading device 11.

Figure 5:
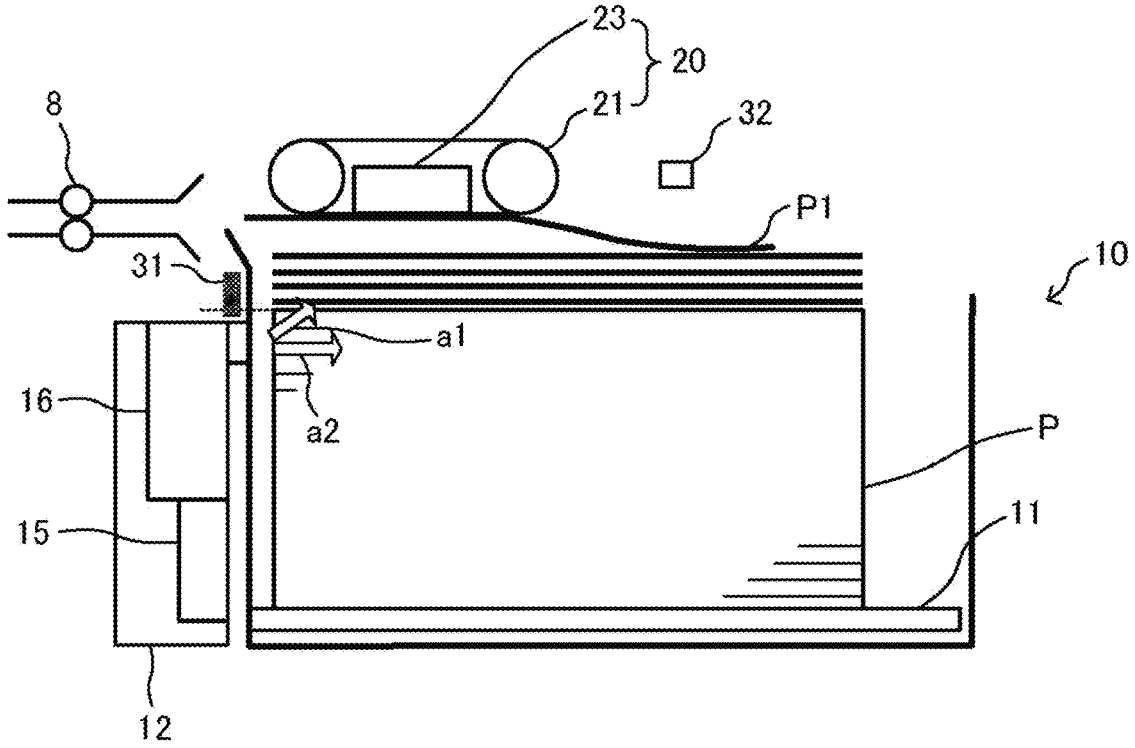
FIG. 5 is a cross sectional view of the sheet tray included in the sheet feeding device.

FIG. 5 is a cross sectional view illustrating the sheet tray 10 included in the sheet feeding device 200.

In addition, a pair of sheet conveying rollers 8 is disposed downstream from the attraction belt 21 in the sheet conveying direction. The pair of sheet conveying rollers 8 functions as a downstream sheet conveying body to convey the sheet P that has been separated from the bundle of sheets and conveyed by the attraction belt 21 reaches between two rollers of the pair of sheet conveying rollers 8. The sheet P is then conveyed toward a further downstream side of the sheet conveying direction.

Further, as illustrated in FIG. 5, the sheet detection sensor 31 described above is provided along a sheet loading direction.

Further, in the present embodiment, the sheet detection sensor 31 includes the first upper end face sensor 31*a* and the second upper end face sensor 31*b* as described above. The sheet detection sensor 31 includes reflective optical sensors, each including a light emitting element and a light receiving element.

Further, the front air blowing device 12 includes the air blowing fans 15 and an air duct 16. The air duct 16 is connected to an air discharging port and includes a floating nozzle and a separating nozzle to which air is guided.

Next, a detailed description is given of the sheet feeding device 200 according to the present embodiment of this disclosure, with examples.

Example 1

A description is given of the sheet feeding device 200 of Example 1 according to the present embodiment.

First, a description is given of an elevation control of the sheet detection sensor 31 and the sheet loading device 11.

Figure 6:
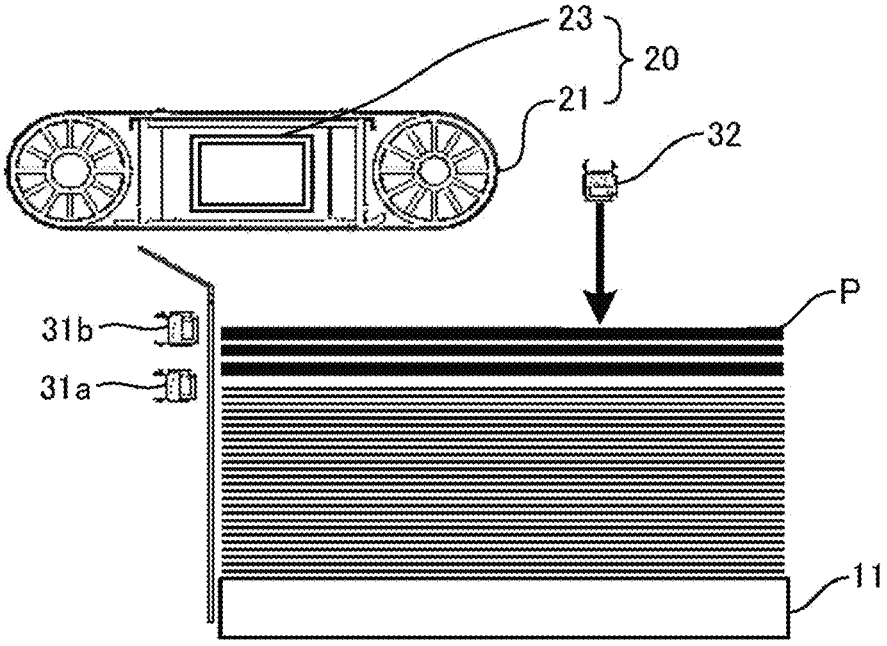
FIG. 6 is a diagram illustrating a first upper end face sensor and a second upper end face sensor provided to a sheet detection sensor, and a paper end sensor.

FIG. 6 is a diagram illustrating the first upper end face sensor 31*a*, the second upper end face sensor 31*b*, and the paper end sensor 32 and explains detection of the upper end face of the bundle of sheets during a sheet feeding operation in an air sheet feeding mechanism of the front air blowing device 12 and the side air blowing devices 13.

The first upper end face sensor 31*a* in FIG. 6 may detect the bundle of sheets in a non-floating state. The second upper end face sensor 31*b* in FIG. 6 is disposed above the first upper end face sensor 31*a* may detect floating sheets of the bundle of sheets to which the floating air is blown.

Further, the first upper end face sensor 31*a* is set to detect a position of 18 mm below the air drawing face of the attraction belt 21 and the second upper end face sensor 31*b* is set to detect a position of 12 mm below the air drawing face of the attraction belt 21.

Figure 7:
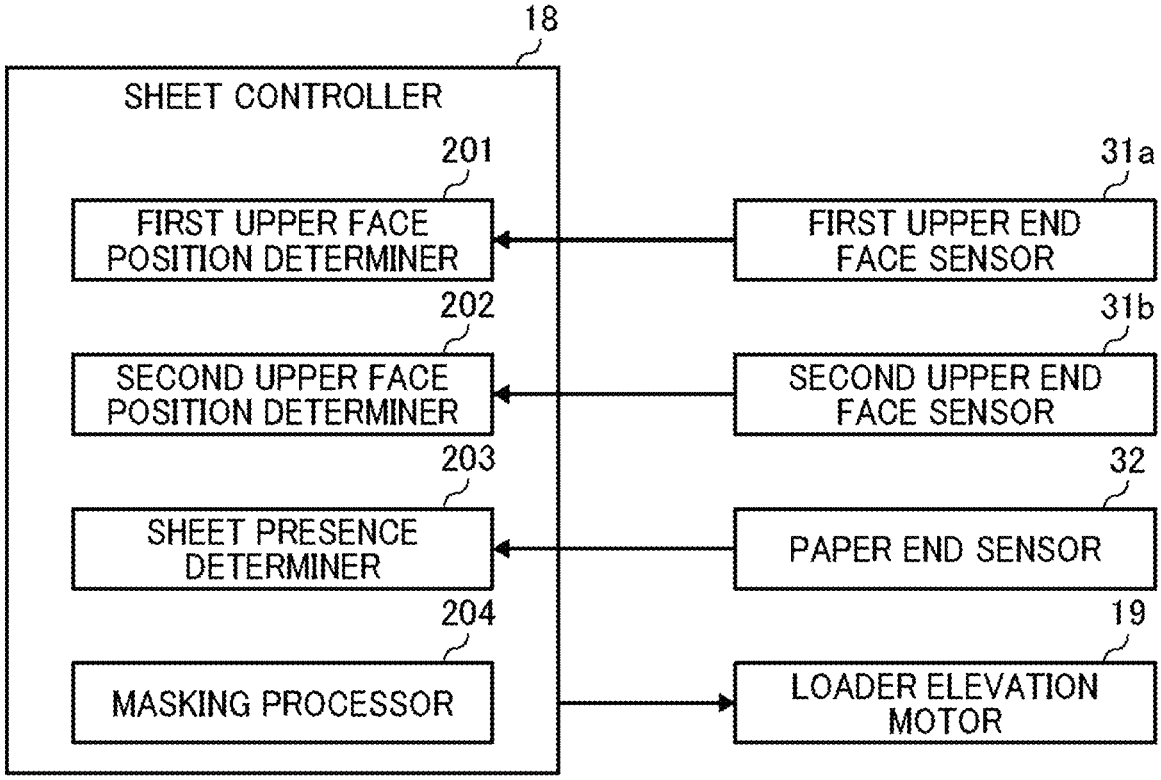
FIG. 7 is a block diagram illustrating a main configuration of a control system of the sheet feeding device.

FIG. 7 is a block diagram illustrating a main configuration of a control system of the sheet feeding device 200.

As illustrated in FIG. 7, a sheet controller 18 that functions as a control circuitry of the sheet feeding device 200 is connected to the first upper end face sensor 31*a*, the second upper end face sensor 31*b*, the paper end sensor 32, and a loader elevation motor 19 of the sheet tray 10.

Consequently, the sheet controller 18 includes a first upper face position determiner 201 and a second upper face position determiner 202. The first upper face position determiner 201 functions as a first position determiner to determine presence or absence of the sheet P at a predetermined position (i.e., a first position), in other words, to determine whether the sheet is located at a level of the first position, in an elevating direction based on an output value of the first upper end face sensor 31*a*. The second upper face position determiner 202 functions as a second position determiner to determine presence or absence of the sheet P at another predetermined position (i.e., a second position), in other words, to determine whether the sheet is located at a level of the second position, in the elevating direction based on an output value of the second upper end face sensor 31*b*. The sheet controller 18 further includes a sheet presence determiner 203 and a masking processor 204. The sheet presence determiner 203 determines presence or absence of the sheet P on the sheet loading device 11 based on an output value of the paper end sensor 32. The masking processor 204 performs masking. Details of the masking is described below.

By providing the sheet controller 18 as described above, even if the sheet feeding device 200 is connected to an image forming apparatus that is not capable of controlling the loader elevation motor 19 that functions as a loader elevating device to move the sheet loading device 11 up and down, in other words, to lift and lower the sheet loading device 11, the sheet feeding device 200 can feed the sheet at an appropriate timing.

Figure 8:
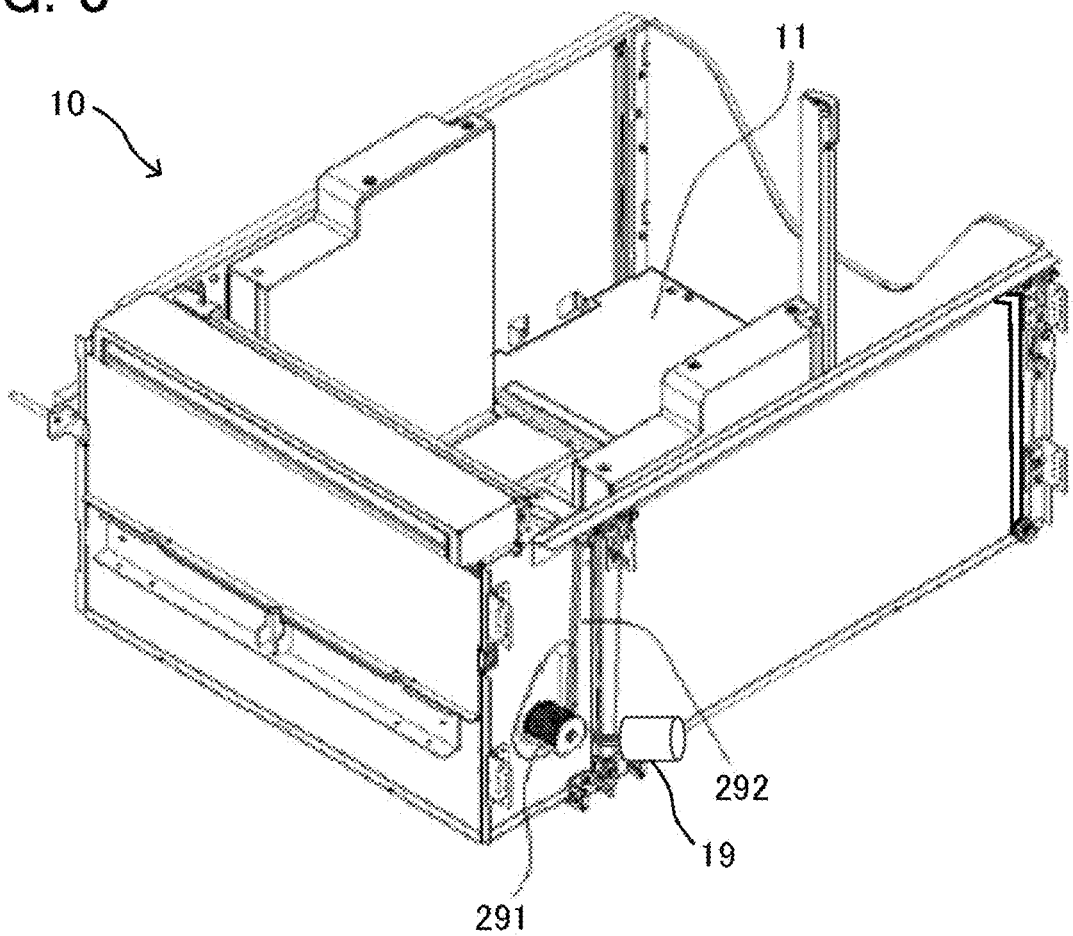
FIG. 8 is a diagram illustrating an elevating device of the sheet feeding device.

FIG. 8 is a diagram illustrating the loader elevating device of the sheet feeding device 200.

As illustrated in FIG. 8, the sheet loading device 11 is connected to a wire 292. As a pulley 291 rotates to take up the wire 292, the sheet loading device 11 is lifted while a loading face of the sheet loading device 11 remains horizontal or level. The pulley 291 is coupled to a drive shaft of the loader elevation motor 19 via a gear train. As the drive shaft of the loader elevation motor 19 rotates, the wire 292 is taken up.

For example, the loader elevation motor 19 is driven to lift or lower the sheet loading device 11. When the sheet loading device 11 is lifted, the sheet P is detected by a reflective optical sensor of the first upper end face sensor 31*a*. Then, the loader elevation motor 19 is stopped, and presence or absence of the sheet is detected by a reflective optical sensor of the paper end sensor 32. When the sheet presence determiner 203 determines that a sheet is loaded on the sheet loading device 11, an upper position is determined, and an initial operation is completed.

However, when the sheet presence determiner 203 determines that a sheet is not loaded on the sheet loading device 11, the sheet loading device 11 is lifted so that the sheet P is lifted to the position of the second upper end face sensor 31*b* (that is, the second upper end face sensor 31*b* is disposed above the first upper end face sensor 31*a* in the present embodiment), and the paper end sensor 32 checks whether or not a sheet is loaded on the sheet loading device 11 (in other words, whether a sheet is present or absent on the sheet loading device 11). When the paper end sensor 32 has detected the sheet loaded on the sheet loading device 11, the masking is performed to the paper end sensor 32, and the sheet loading device 11 is lowered so that the sheet P is lowered to the position of the first upper end face sensor 31*a*.

Further, at the position of the second upper end face sensor 31*b*, when the sheet presence determiner 203 has determined that a sheet is not loaded on the sheet loading device 11 based on the output value of the paper end sensor 32, data of absence of sheet is sent to the image forming apparatus 100, and consequently the sheet loading device 11 is lowered to a lower end position.

Here, the sheet feeding device 200 according to the present embodiment is effective when feeding black sheets or curled sheets.

A configuration of a comparative paper end sensor that employs a reflective optical sensor has inconvenience in detection accuracy with respect to black sheet. To be more specific, since a reflective optical sensor detects reflection light on the surface of a detection target, the detection distance is susceptible to the property of the detection target and the condition of the surface of the detection target. Generally, a detection target having higher reflectance has higher detection accuracy, and therefore the relative detection distance is shorter with respect to matte (non-gloss) sheet and black sheet. Since the reflectance is relatively low to a black sheet and a sheet having low reflectance, it is difficult to detect such sheets by a reflective optical sensor. Accordingly, even when a sheet is loaded on a sheet loading device, it is highly likely that no sheet is detected erroneously.

For example, when a black sheet or a sheet having low reflectance is fed, the paper end sensor 32 that employs a reflective optical sensor having low reflectance may not detect such sheets at the position of the first upper end face sensor 31*a* in the initial operation. In this case, the sheet loading device 11 is lifted to the position of the second upper end face sensor 31*b*, so that the presence or absence of the sheet is checked at a position closer to the paper end sensor 32. However, when a sheet feed job is started, the sheet is lowered from the position of the second upper end face sensor 31*b* to the position of the first upper end face sensor 31*a*.

As the sheet loading device 11 is lowered, the paper end sensor 32 cannot detect a black sheet and a sheet having low reflectance, and therefore an erroneous "sheet absent" detection occurs.

In order to address this inconvenience, in a case in which the sheet loading device 11 is lowered after the sheet is lifted from the position of the first upper end face sensor 31*a* to the position of the second upper end face sensor 31*b*, even if the paper end sensor 32 does not detect any sheet, the masking is performed to cause the sheet presence determiner 203 to determine "sheet present". Accordingly, the erroneous "sheet absent" detection when the sheet is on the sheet loading device 11 is prevented.

Figure 9:
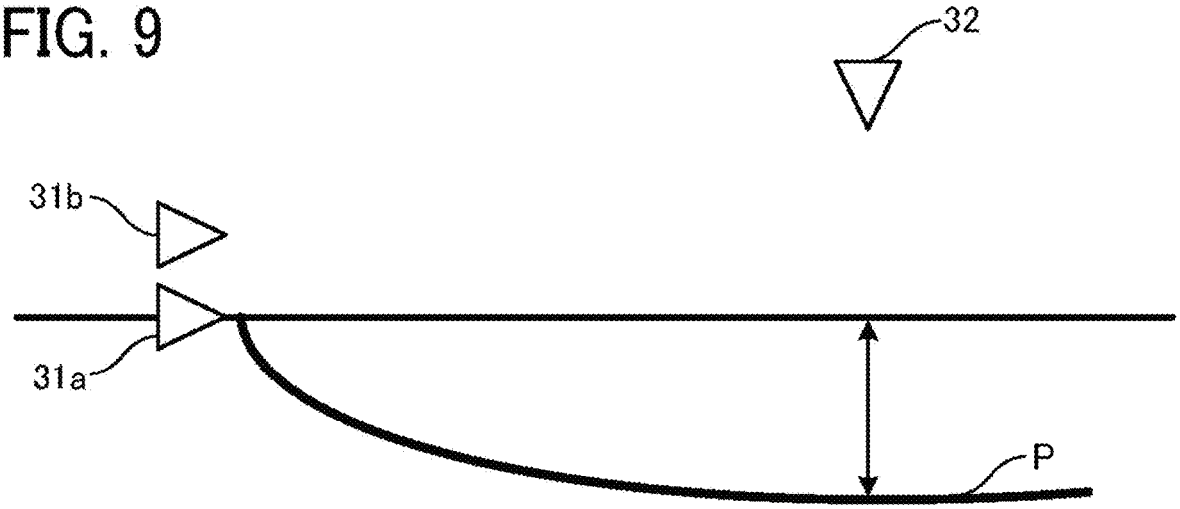
FIG. 9 is a diagram illustrating defects in a detection of presence or absence of a sheet, with respect to black sheets and curled sheets.

FIG. 9 is a diagram illustrating defects in sheet presence or absence detection with respect to a black sheet and a curled sheet.

Similarly, when a curled sheet is fed, the same inconvenience as in feeding a black sheet or a sheet having low reflectance occurs. That is, as illustrated in FIG. 9, the sheet loading device 11 stops at the position of the first upper end face sensor 31*a*. Therefore, even if the paper end sensor 32 attempts detection of presence or absence of the sheets on the sheet loading device 11, the position of the sheet loading device 11 is farther than a regular position. Accordingly, it is highly likely that the paper end sensor 32 erroneously detects that no sheet is loaded on the sheet loading device 11 even when the sheet is actually loaded on the sheet loading device 11.

Masking.

Examples of masking are a method of using a latch circuit between the paper end sensor 32 and the sheet controller 18 (the sheet presence determiner 203) and a method of using a dummy detection target member movably disposed within a detection area of the paper end sensor 32.

Cancellation of Masking.

When the above-described masking is performed, if the paper end sensor 32 is not changed (reverted) to the actual detecting operation at the start of the sheet feed job, the paper end sensor 32 cannot determine the state correctly at the actual end of the sheets (the paper end) on the sheet loading device 11. In order to address this inconvenience, in a case in which the paper end sensor 32 has not detected the sheet at the position to which the sheet loading device 11 is lifted until the first upper end face sensor 31*a* detects the sheet at the start of the sheet feed job but has detected the sheet at the position when the sheet loading device 11 is further lifted to the position at which the second upper end face sensor 31*b* detects the sheet, the masking is cancelled. It is to be noted that the operation in which the sheet loading device 11 is lifted up to the second upper end face sensor 31*b* is referred to as a "two-step elevation."

Next, a description is given of the upper end face detection of a sheet during the sheet feeding operation in the air sheet feeding mechanism of the front air blowing device 12 and the side air blowing devices 13 that has been described with reference to FIG. 6.

Air is first blown at the position at which the height of the bundle of sheets is equal to the position of the first upper end face sensor 31*a* as illustrated in FIG. 6, and the sheet loading device 11 is lifted such that an uppermost sheet P when the flow of air is stable is at the position of the second upper end face sensor 31*b*. When the uppermost sheet P is at the position of the second upper end face sensor 31*b*, a subsequent sheet or subsequent sheets are separated from the uppermost sheet P appropriately, and consequently sheets are separated reliably.

Further, the position of the second upper end face sensor 31*b* is preferable when a sheet such as a black sheet is detected from the position of the paper end sensor 32.

Next, a description is given of the initial operation of handling sheets such as black sheets with reference to the drawings.

Figure 10A:
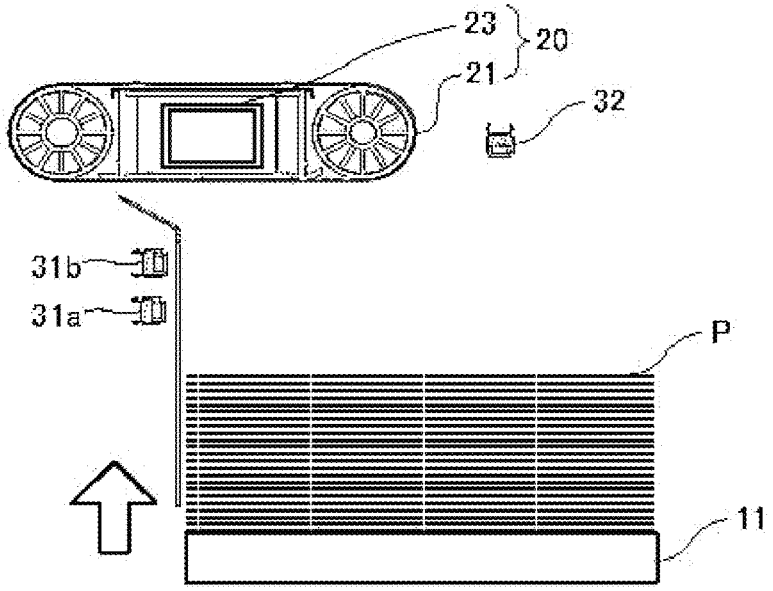
FIGS. 10A, 10B, and 10C are diagrams illustrating an initial operation when handling sheets such as black sheets.
Figure 10B:
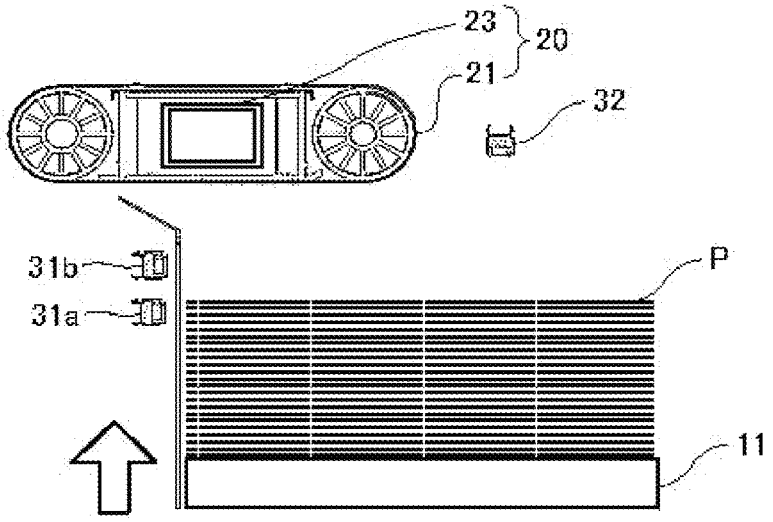
Figure 10C:
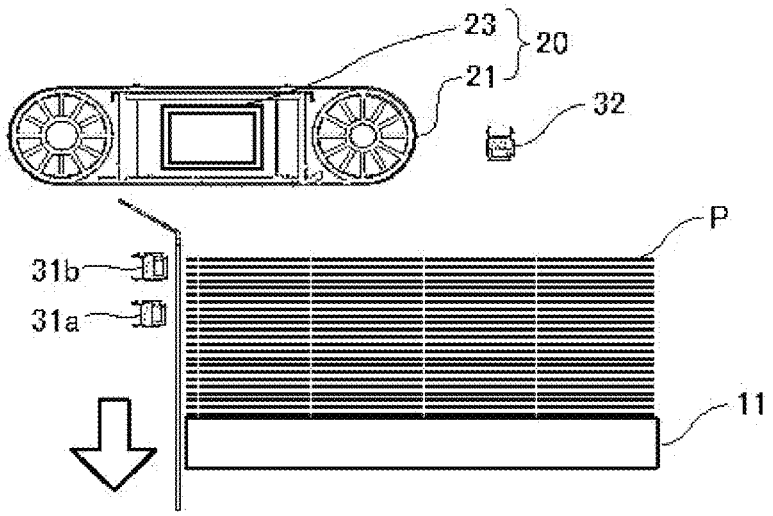

FIGS. 10A, 10B, and 10C are diagrams illustrating the initial operation when handling sheets such as black sheets.

In the initial operation of handling sheets such as black sheets, the sheet loading device 11 is first lifted from below the first upper end face sensor 31*a* toward the first upper end face sensor 31*a*, as illustrated in FIG. 10A.

Thereafter, the paper end sensor 32 detects presence or absence of the sheet at the position at which the first upper end face sensor 31*a* detects the sheet on the sheet loading device 11, as illustrated in FIG. 10B. When no sheet is detected at the position of the first upper end face sensor 31*a*, the sheet loading device 11 is further lifted.

Then, as illustrated in FIG. 10C, the paper end sensor 32 detects presence or absence of the sheet at the position at which the second upper end face sensor 31*b* detects the sheet on the sheet loading device 11. When a sheet is detected, the sheet loading device 11 is lowered to the position at which the first upper end face sensor 31*a* detects the sheet. At this time, it is highly likely that the paper end sensor 32 detects no sheet erroneously when a sheet with low reflectance such as a black sheet is loaded. In order to avoid this erroneous detection, the paper end sensor 32 is masked and then the sheet loading device 11 is lowered so as not to detect that no sheet is loaded on the sheet loading device 11.

Next, a description is given of the end of the sheet feed job of black sheet or the like, with reference to drawings.

Figure 11A:
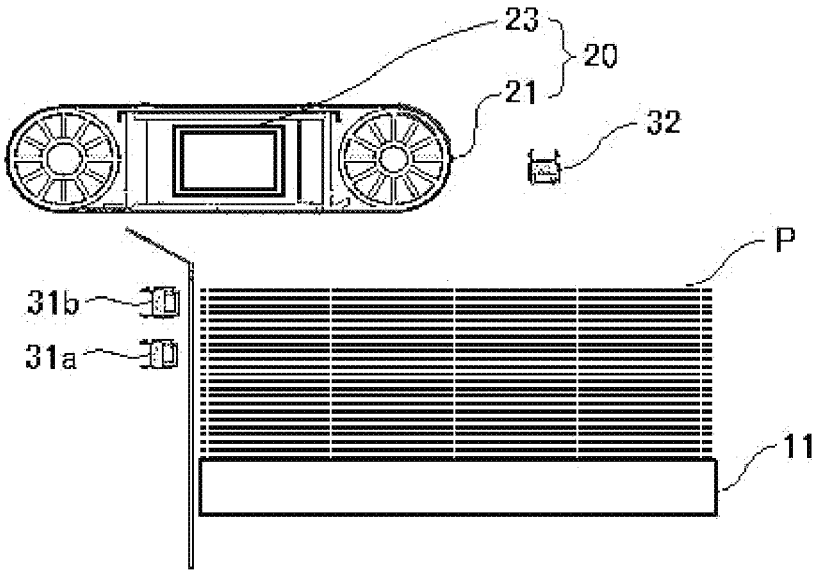
FIGS. 11A and 11B are diagrams illustrating an end of a sheet feed job of a black sheet.
Figure 11B:
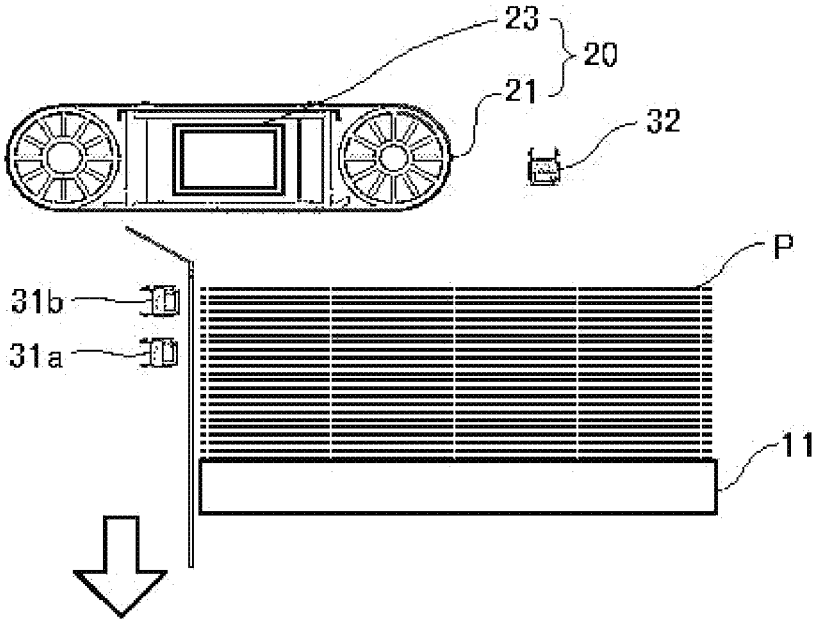

FIGS. 11A and 11B are diagrams illustrating the end of the sheet feed job of a sheet such as a black sheet. Specifically, FIG. 11A is a diagram illustrating the state in which the sheet feed job is ended and FIG. 11B is a diagram illustrating the state in which the sheet loading device 11 is lowered to a position below the first upper end face sensor 31*a*.

At the end of the sheet feed job, the bundle of sheets is stopped at the position of the second upper end face sensor 31*b*, as illustrated in FIG. 11A.

In this state, the paper end sensor 32 detects presence or absence of the sheet on the sheet loading device 11. When the sheet is loaded on the sheet loading device 11, the sheet loading device 11 is lowered to a position below the first upper end face sensor 31*a* and the second upper end face sensor 31*b*, as indicated by arrow in FIG. 11B. However, when the sheet is a black sheet or a sheet with low reflectance, it is likely that the paper end sensor 32 detects that no sheet is loaded on the sheet loading device 11. Therefore, in order to avoid this erroneous detection, the masking is performed to the paper end sensor 32 so as not to detect an erroneous "sheet absent" detection, and then the sheet loading device 11 is lowered.

Next, a description is given of the flow of the initial operation, with reference to drawings.

Figure 12A:
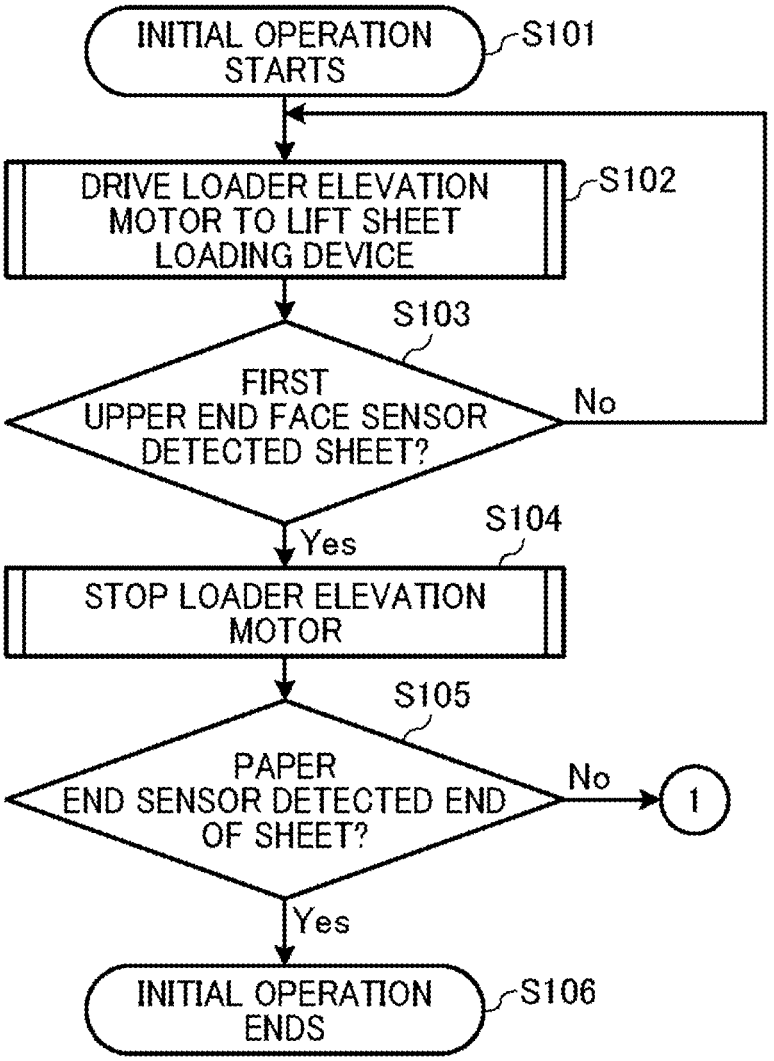
FIG. 12 (including FIGS. 12A and 12B) is a flowchart of processes of the initial operation.
Figure 12B:
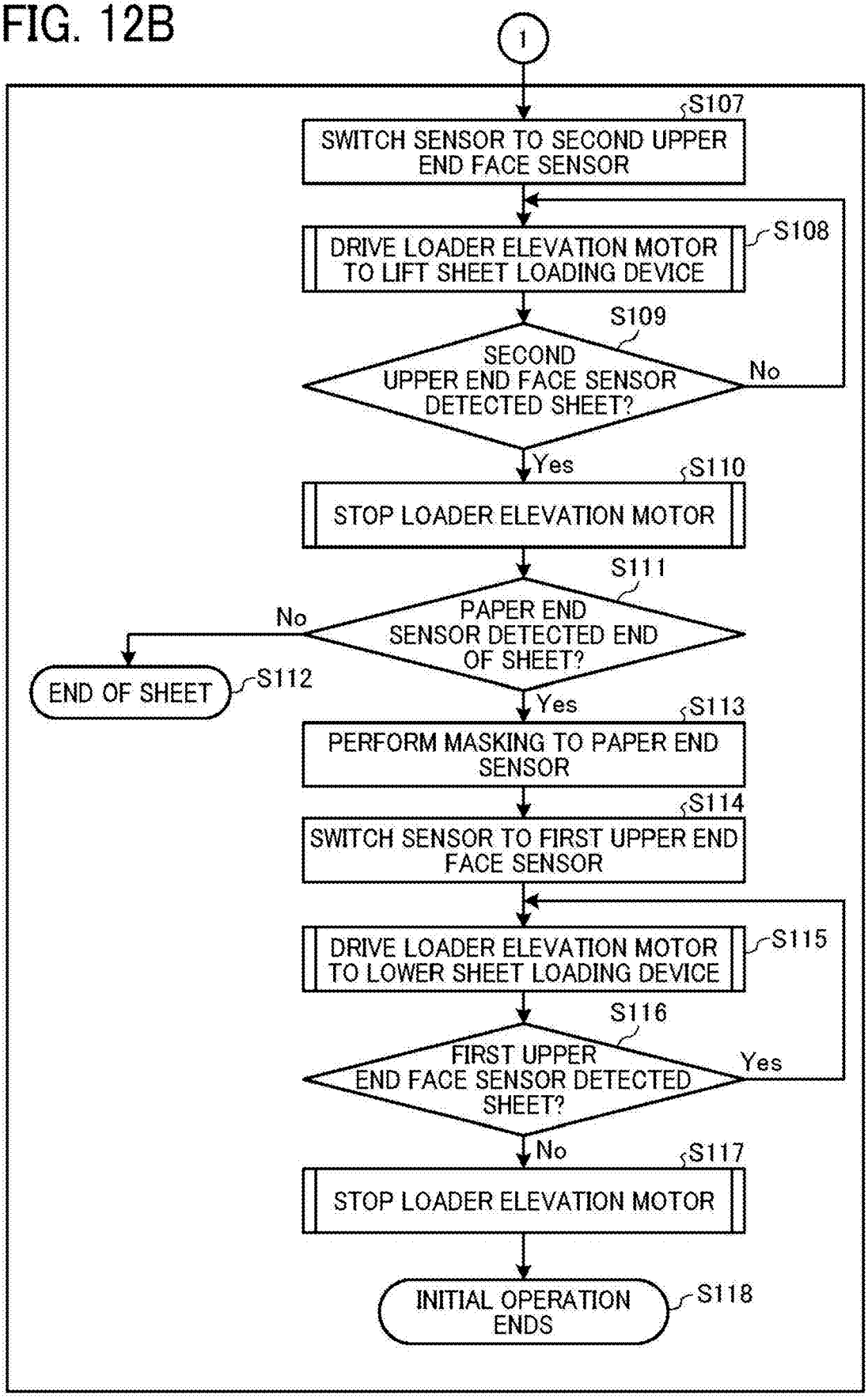

FIG. 12 (including FIGS. 12A and 12B) is a flowchart of the initial operation.

When the sheet tray 10 is set or the power is turned on, the initial operation is started (step S101). Then, as illustrated in the flowchart of FIG. 12, the loader elevation motor 19 is driven to lift the sheet loading device 11 (step S102), and then it is determined whether or not the first upper end face sensor 31*a* has detected (the presence of) the sheet (in other words, whether the first upper end face sensor 31*a* has detected that the sheet is present or absent on the sheet loading device 11) (step S103). When the first upper end face sensor 31*a* has not detected the sheet (NO in step S103), the procedure returns to step S102 to lift the sheet loading device 11. The procedures are repeated until the first upper end face sensor 31*a* detects the sheet. By contrast, when the first upper end face sensor 31*a* has detected the sheet (YES in step S103), the loader elevation motor 19 is stopped (step S104).

After the loader elevation motor 19 has stopped (step S104), it is checked whether the paper end sensor 32 has detected the end of sheets, in other words, the paper end sensor 32 has detected that the absence of the sheet, i.e., the end of sheets or the paper end (step S105). When the paper end sensor 32 has detected the end of sheets (YES in step S105), the initial operation ends (step S106). By contrast, when the paper end sensor 32 has not detected the end of sheets (NO in step S105), the procedure goes to the two-step elevation to lift the sheet loading device 11 again until the second upper end face sensor 31*b* detects the sheet.

In the two-step elevation, the sensor to perform the detection is switched to the second upper end face sensor 31*b* (step S107), the loader elevation motor 19 is driven to lift the sheet loading device 11 (step S108), and it is determined whether the second upper end face sensor 31*b* has detected the sheet on the sheet loading device 11 (step S109). When the second upper end face sensor 31*b* has not detected the sheet (NO in step S109), the procedure returns to step S108 to lift the sheet loading device 11. The procedures are repeated until the second upper end face sensor 31*b* detects the sheet. By contrast, when the second upper end face sensor 31*b* has detected the sheet (YES in step S109), the loader elevation motor 19 is stopped (step S110).

After the loader elevation motor 19 has stopped (step S110), it is checked whether or not the paper end sensor 32 has detected the end of sheets, in other words, the absence of the sheets or the paper end (step S111). When the paper end sensor 32 has not detected the end of sheets (NO in step S111), the procedure goes to step S112 to be confirmed as the end of sheets. By contrast, when the paper end sensor 32 has detected the end of sheets (YES in step S111), the masking is performed to the paper end sensor 32.

After the masking has been performed to the paper end sensor 32 (step S113), the sensor to perform the detection is switched to the first upper end face sensor 31*a* (step S114). Then, the loader elevation motor 19 is driven to lower the sheet loading device 11 (step S115), and it is determined whether or not the first upper end face sensor 31*a* has detected the sheet on the sheet loading device 11 (step S116). When the first upper end face sensor 31*a* has detected the sheet (YES in step S116), the procedure returns to step S115 to lower the sheet loading device 11 (i.e., the loader elevation motor 19). The procedures are repeated until the first upper end face sensor 31*a* no longer detects the sheet. When the first upper end face sensor 31*a* has not the sheet (NO in step S116), the loader elevation motor 19 is stopped (step S117), and the initial operation ends (step S118).

Further, when the two-step elevation is performed, it is stored that the sheet loading device 11 has lifted by two steps.

In other words, when the sheet tray is set or when the power is turned on, the loader elevation motor 19 is lifted so as to lift the sheet loading device 11 until the first upper end face sensor 31*a* detects the sheet. Then, when the first upper end face sensor 31*a* detects the sheet, it is checked whether or not the paper end sensor 32 has detected the sheet on the sheet loading device 11. When the paper end sensor 32 has not detected the sheet, the two-step elevation in which the sheet loading device 11 is further lifted until the second upper end face sensor 31*b* detects the sheet is performed.

When the second upper end face sensor 31*b* has detected the sheet, it is checked again whether or not the paper end sensor 32 has detected the sheet on the sheet loading device 11. When the paper end sensor 32 has detected that the sheet is loaded on the sheet loading device 11, the masking is performed to the paper end sensor 32, and the sheet loading device 11 is lowered until the first upper end face sensor 31*a* no longer detects the sheet. Then, the initial operation ends.

Further, when the two-step elevation is performed, it is stored that the sheet loading device 11 has lifted by two steps, as described above.

Next, a description is given of the flow at the start of the sheet feed job, with reference to drawings.

Figure 13:
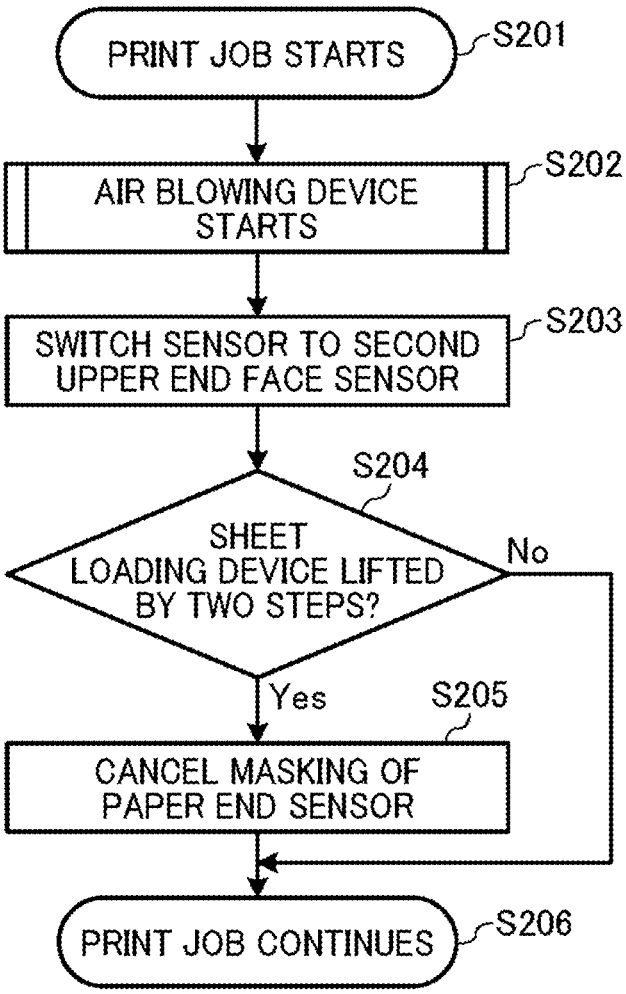
FIG. 13 is a flowchart of processes at a start of the sheet feed job.

FIG. 13 is a diagram illustrating a flowchart at the start of the sheet feed job.

As illustrated in the flowchart of FIG. 13, when the printing is started, in other words, when a print job has started (step S201), the air blowing device 17 is started (i.e., the air blowing fan is started rotating) (step S202), and the sensor to perform the detection is switched to the second upper end face sensor 31*b* (step S203).

Thereafter, it is determined whether or not the sheet loading device 11 is lifted by two steps in the above-described initial operation, in other words, whether or not the two-step elevation is performed in the above-described initial operation (step S204). When the sheet loading device 11 is lifted by two steps, in other words, when the two-step elevation is performed (YES in step S204), the masking to the paper end sensor 32 is cancelled (step S205), and the print job is continued (step S206). By contrast, when the sheet loading device 11 is not lifted by two steps, in other words, when the two-step elevation is not performed (NO in step S204), the print job is continued without cancelling the masking of the paper end sensor 32 (step S206).

At the start of the print job, the air blowing device 17 starts to blow air and the sensor to perform the detection is switched to the second upper end face sensor 31*b*. At this time, when the two-step elevation is performed in the initial operation, the masking of the paper end sensor 32 is cancelled.

Next, a description is given of the flow at the end of the sheet feed job, with reference to drawings.

Figure 14:
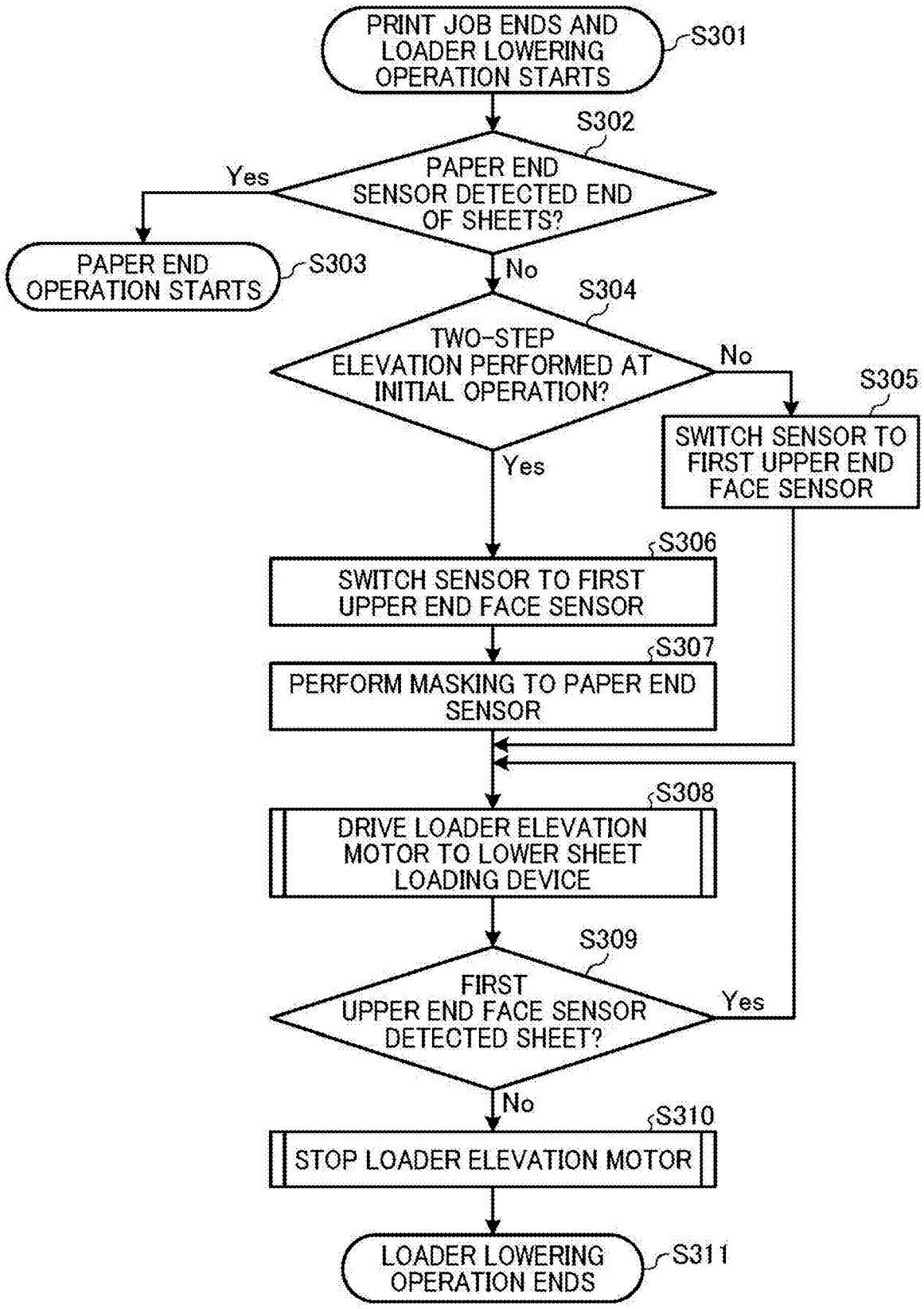
FIG. 14 is a flowchart of processes at an end of the sheet feed job.

FIG. 14 is a diagram illustrating a flowchart at the end of the sheet feed job.

As illustrated in FIG. 14, the print job ends and a loader lowering operation starts (step S301), and it is checked whether or not the paper end sensor 32 has detected the end of sheets (the absence of the sheet or the paper end) on the sheet loading device 11 (step S302). When the paper end sensor 32 has detected the end of sheets (YES in step S302), the procedure goes to a paper end operation (step S303), which will be described below. By contrast, when the paper end sensor 32 has not detected the end of sheets (NO in step S302), the procedure goes to step S304 to check whether or not the two-step elevation is performed at the initial operation (step S304).

When the two-step elevation is not performed at the initial operation (NO in step S304), the sensor to perform the detection is switched to the first upper end face sensor 31*a* (step S305). Then, the loader elevation motor 19 is driven to lower the sheet loading device 11 (step S308). By contrast, when the two-step elevation is performed at the initial operation (YES in step S304), the sensor to perform the detection is switched to the first upper end face sensor 31*a* (step S306). Then, the masking is performed to the paper end sensor 32 (step S307), and the loader elevation motor 19 is driven to lower the sheet loading device 11 (step S308).

After the loader elevation motor 19 is driven and the sheet loading device 11 is stated to be lowered (step S308), it is determined whether or not the first upper end face sensor 31*a* has detected the sheet on the sheet loading device 11 (step S309). When the first upper end face sensor 31*a* has detected the sheet (YES in step S309), the procedure returns to step S308 to lower the sheet loading device 11 (i.e., the loader elevation motor 19). The procedures are repeated until the first upper end face sensor 31*a* no longer detects the sheet. By contrast, when the first upper end face sensor 31*a* has not the sheet (NO in step S309), the loader elevation motor 19 is stopped (step S310), and the loader lowering operation to lower the sheet loading device 11 ends (step S311).

In other words, when the print job ends and the paper end sensor 32 has detected the sheet, the sheet loading device 11 is lowered to the first upper end face sensor 31*a*. In this case, it is highly likely that the paper end sensor 32 erroneously detects that no sheet is loaded on the sheet loading device 11 when a sheet such as a black sheet, a sheet with low reflectance, and a curled sheet that are lifted by two steps at the initial operation is simply lowered. In order to avoid this erroneous detection, the masking is performed to the paper end sensor 32 and the sheet loading device 11 is lowered to the first upper end face sensor 31*a*.

Next, a description is given of the flow at the end of sheets (the paper end), with reference to drawings.

Figure 15:
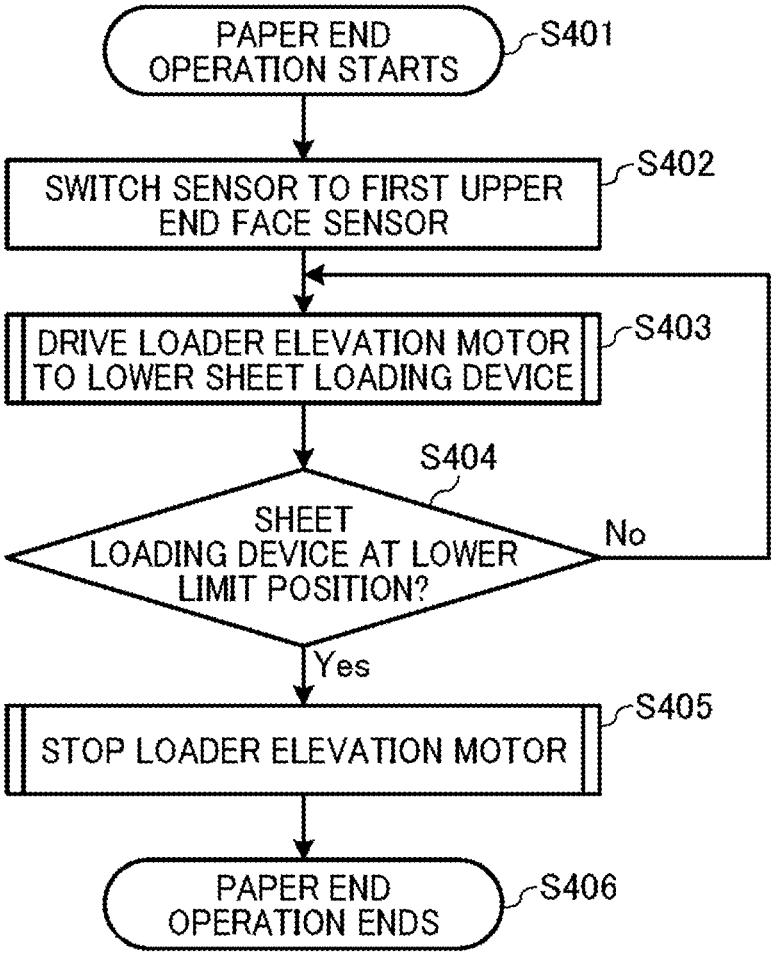
FIG. 15 is a flowchart of processes at a paper end.

FIG. 15 is a diagram illustrating a flowchart at the end of sheets (the paper end).

As illustrated in the flowchart of FIG. 15, when the sheet is not loaded on the sheet loading device 11, in other words, when the paper end operation is started (step S401), the sensor to perform the detection is switched to the first upper end face sensor 31*a* (step S402). Then, the loader elevation motor 19 is driven to lower the sheet loading device 11 (step S403), and it is checked whether or not the sheet loading device 11 (the sheet tray 10) is lowered to a lower limit position of movement of the sheet loading device 11 (step S404).

Then, when the sheet loading device 11 is not lowered to the lower limit position (NO in step S404), the procedure returns to step S403 to lower the sheet loading device 11 (i.e., the loader elevation motor 19). The procedures are repeated until the first upper end face sensor 31*a* no longer detects the sheet.

By contrast, when the sheet loading device 11 is lowered to the lower limit position (YES in step S404), the loader elevation motor 19 is stopped (step S405), and the paper end operation ends (step S406).

The sheet loading device 11 is lowered to the lower limit position (that is, the initial lower limit position) at the end of sheets (the paper end). However, when the two-step elevation is performed, the data of the two-step elevation is reset (cancelled).

Example 2

A description is given of the sheet feeding device 200 of Example 2 according to the present embodiment.

The sheet feeding device 200 of Example 2 has a basic configuration substantially identical to the sheet feeding device 200 of Example 1, except that the method of the masking employed in the sheet feeding device 200 of Example 2 is different from the method of masking employed in the sheet feeding device 200 of Example 1. Accordingly, the description of the same configuration as the sheet feeding device 200 of Example 1 is omitted. That is, the following detailed description explains the method of masking different from Example 1.

Examples of the masking are the method of using the latch circuit between the paper end sensor 32 and the sheet controller 18 (the sheet presence determiner 203) and the method of using the dummy detection target member movably disposed within the detection area of the paper end sensor 32.

First, a description is given of the method of using the latch circuit between the paper end sensor 32 and the sheet controller 18 (the sheet presence determiner 203), with reference to the drawings.

Figure 16A:
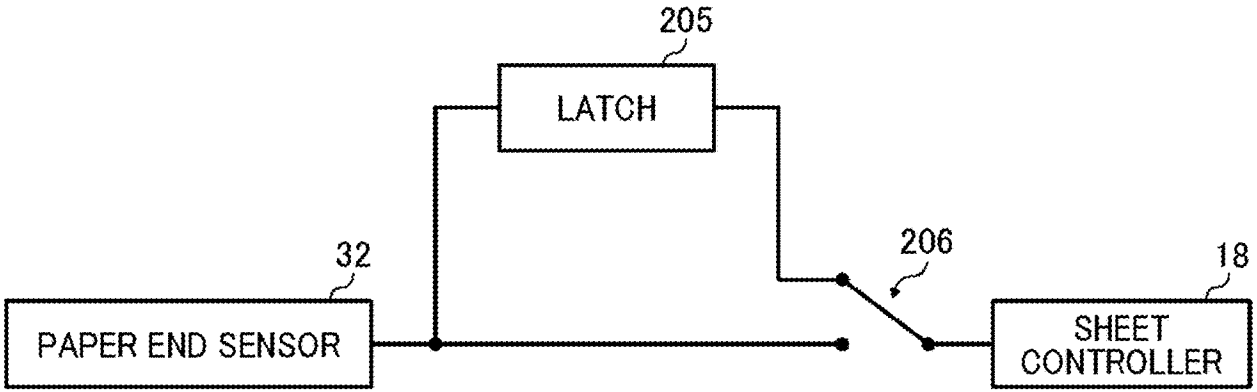
FIGS. 16A and 16B are diagrams illustrating a configuration in which an output (signal) of a paper end sensor is sent via a latch circuit even when a detection result obtained by the paper end sensor is presence of sheet or absence of sheet.
Figure 16B:
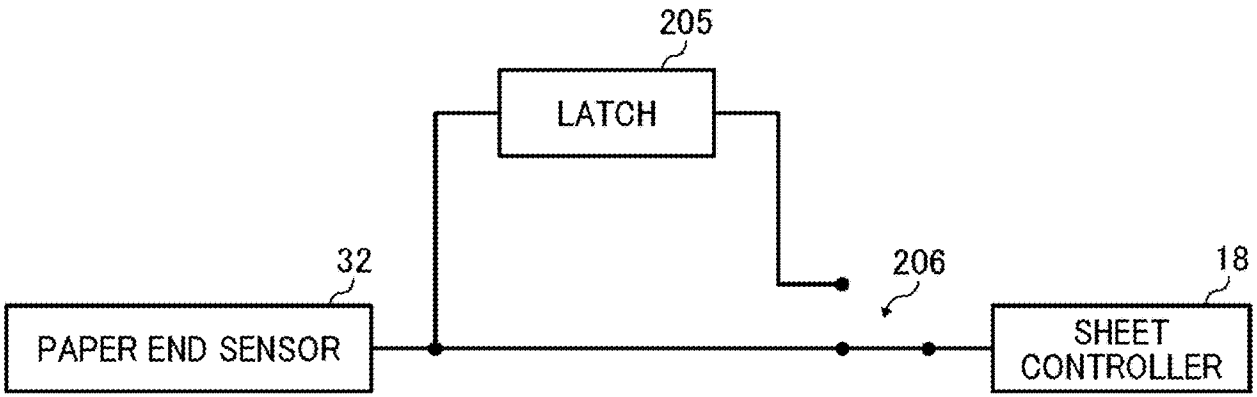

FIGS. 16A and 16B are diagrams illustrating a configuration in which an output (signal) of the paper end sensor 32 is sent regardless of a detection result (sheet present or sheet absent) obtained by the paper end sensor 32 via the latch circuit. Specifically, FIG. 16A illustrates a state of the latch circuit in which a latch 205 is fixed to the detected state of presence of sheet, that is, the sheet is present on the sheet loading device 11. By contrast, FIG. 16B illustrates a state of the latch circuit in which the latch 205 is reset to check the output of the paper end sensor 32 directly, that is, without passing through the latch 205.

As illustrated in FIGS. 16A and 16B, this method of masking is provided with a latch circuit that is capable of switching signal paths between the paper end sensor 32 and the sheet controller 18 (the sheet presence determiner 203).

When the masking is performed, as illustrated in FIG. 16A, a switch 206 switches to a state in which the signal (the output) of the paper end sensor 32 is input to the sheet controller 18 via the latch 205.

By contrast, when the masking is cancelled, as illustrated in FIG. 16B, the switch 206 switches to a state in which the signal (the output) of the paper end sensor 32 is input directly to the sheet controller 18 without passing through the latch 205.

By providing the above-described configuration, the signal passes through the latch circuit when the two-step elevation is performed, and when the paper end sensor 32 detects the sheet, the latch 205 is fixed to the detected state that the sheet is present on the sheet loading device 11. Further, the latch 205 may be reset at the start of the sheet feed job, and the output of the paper end sensor 32 may be input directly to the sheet controller 18.

Next, a description is given of the method of using the dummy detection target member movably disposed within the detection area of the paper end sensor 32, with reference to the drawings.

Figure 17A:
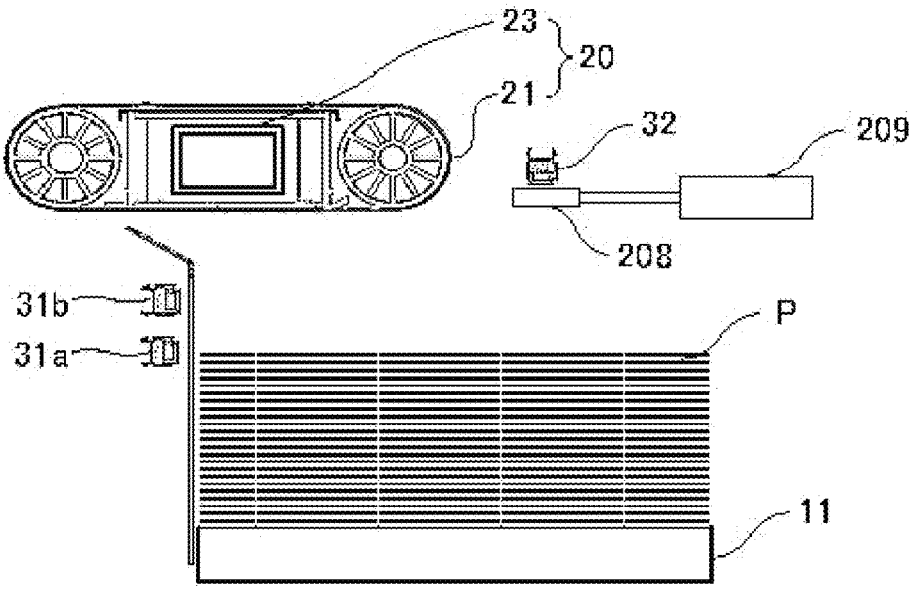
FIGS. 17A and 17B are diagrams illustrating a configuration in which a movable dummy detection target member in a detection area of the paper end sensor.
Figure 17B:
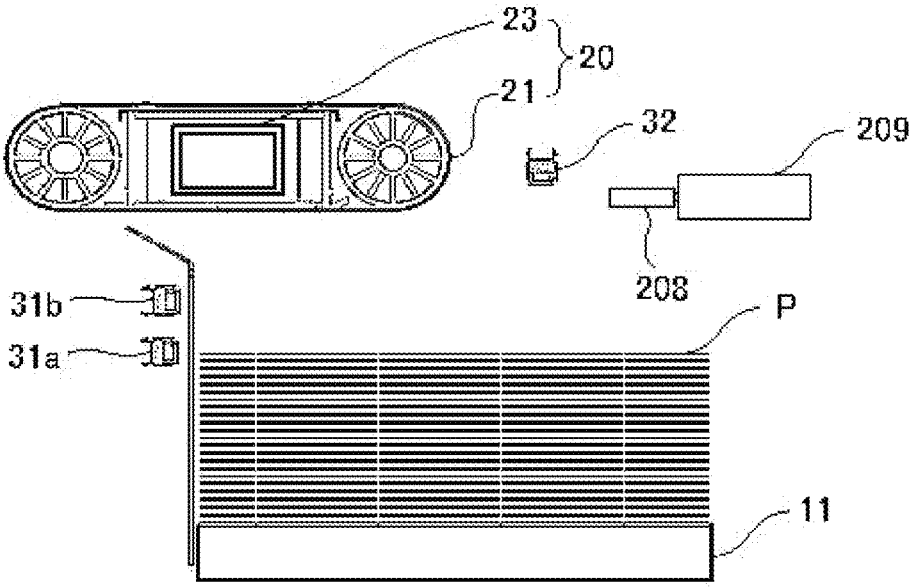

FIGS. 17A and 17B are diagrams illustrating a configuration in which the dummy detection target member is movably disposed within the detection area of the paper end sensor 32. Specifically, FIG. 17A is a diagram illustrating a state in which the dummy detection target member is detected by the paper end sensor 32. By contrast, FIG. 17B illustrates a state in which the dummy detection target member is retreated from the detection area of the paper end sensor 32.

As illustrated in FIGS. 17A and 17B, this method of masking is provided with a dummy detection target sensor 208 that functions as a dummy detection target member such as a feeler and a film sheet, and a moving device 209 such as a solenoid. The moving device 209 moves the dummy detection target sensor 208 from a non-detection area of the paper end sensor 32 to enter a detection area of the paper end sensor 32.

When performing the masking, as illustrated in FIG. 17A, the moving device 209 moves the dummy detection target sensor 208 from the non-detection area of the paper end sensor 32 so that the dummy detection target sensor 208 enters the detection area of the paper end sensor 32.

By contrast, when cancelling the masking, as illustrated in FIG. 17B, the moving device 209 moves the dummy detection target sensor 208 from the detection area of the paper end sensor 32 so that the dummy detection target sensor 208 enters the non-detection area of the paper end sensor 32.

By providing the above-described configuration, after the sheet loading device 11 has lifted by two steps, even while the sheet loading device 11 is being lowered to the position at which the first upper end face sensor 31*a* detects the top of the sheet, the detection result of the paper end sensor 32 is presence of sheet, that is, the sheet is loaded on the sheet loading device 11. Accordingly, the paper end sensor 32 does not perform erroneous detection that the sheet is absent. Further, the moving device 209 may move the dummy detection target sensor 208 from the detection area of the paper end sensor 32 to the non-detection area of the paper end sensor 32 at the start of the sheet feed job, and the detection result of the paper end sensor 32 may be input to the sheet controller 18.

The above-described embodiments and examples are illustrative and are not limited to the configuration that is provided with the sheet feeding device 200. It is therefore to be understood that within the scope of the appended claims, numerous additional modifications and variations are possible to this disclosure otherwise than as specifically described herein.

For example, in the present embodiment, the sheet feeding device 200 connected to the electrophotographic image forming apparatus 100 has been described. However, the configuration to be applied to this disclosure is not limited to a sheet feeding device connected to an electrophotographic image forming apparatus. For example, an inkjet image forming apparatus may also be employed as an image forming apparatus that is connectable to the sheet feeding device 200.

Further, an apparatus or a device that is connected to or includes the sheet feeding device is not limited to an image forming apparatus. For example, a sheet folding apparatus that performs a sheet folding operation or a device such as a sheet inspection device to inspect sheets or processed sheets may be applied.

Further, in the above-described embodiments and examples, the description was given of the configuration in which the first upper end face sensor 31*a* and the second upper end face sensor 31*b* detect the first position and the second position, respectively. However, the configuration of the sheet feeding device is not limited to this configuration.

For example, this disclosure may be applied to a configuration in which it is determined that the top of the sheets has reached the second position as the loader elevating device lifts the sheet loading device from the first position by a predetermined amount (pulses) or to a configuration in which the upper end face sensor is movable from the first position to the second position.

By providing the above-described configuration, the end of sheets (the paper end) is detected correctly without providing multiple upper end face sensors.

Further, in the above-described embodiments and examples, the description was given of the configuration in which the first upper end face sensor 31*a* and the second upper end face sensor 31*b* are reflective optical sensors. However, the sensor type is not limited to the reflective optical sensor but may be a contact type sensor.

Further, in the above-described embodiments and examples, the description was given of the image forming system 1 that is provided with the image forming apparatus 100 and the sheet feeding device 200. However, the configuration of a system that includes a sheet feeding device is not limited to the above-described configuration. For example, this disclosure may be applied to a sheet folding system that includes a sheet folding device that performs a sheet folding operation to a sheet or sheets and a sheet feeding device.

Further, the sheet is not limited to plain paper material but may be prepreg material.

Prepreg is used as material of laminate plate and multilayer printed wiring board. For example, the prepreg includes a sheet-like material that is manufactured by, for example, continuously impregnating a resin varnish mainly formed by a thermosetting resin such as epoxy resin, polyimide resin, into an elongated base such as glass cloth, paper, non-woven cloth, and aramid cloth, then heating or drying, and cutting.

The configurations according to the above-descried embodiments are not limited thereto. This disclosure can achieve the following aspects effectively.

Aspect A.

In Aspect A, a sheet feeding device (for example, the sheet feeding device 200) includes a sheet loader (for example, the sheet loading device 11) on which a bundle of sheets (for example, the sheet(s) P) is loaded, a loader elevating device (for example, the loader elevation motor 19) configured to move the sheet loader in a vertical direction, a sheet presence detector (for example, the paper end sensor 32) configured to detect whether the sheet is loaded on the sheet loader, a sheet presence determiner (for example, the sheet presence determiner 203) configured to determine whether the sheet is loaded on the sheet loader based on a detection result obtained by the sheet presence detector, and circuitry (the sheet controller 18) configured to control movement of the loader elevating device. In response to a detection result obtained by the sheet presence detector indicating that the sheet is absent on the sheet loader at a first position in the vertical direction of the sheet loader, the circuitry is configured to perform a control to cause the loader elevating device to lift the sheet loader to a second position that is above the first position. The circuitry is configured to cause the sheet presence determiner not to determine that the sheet is absent on the sheet loader when the circuitry controls the loader elevating device to lower the sheet from the second position to the first position after the circuitry has performed the control.

According to this configuration, the following effects can be achieved.

In a comparative sheet feeding device, in order to start the sheet feeding operation from an appropriate position, when the sheet loader is lowered from the second position, it is likely that the end of sheet (the paper end) is erroneously detected, and therefore a stable sheet feeding operation was difficult to perform.

This erroneous detection occurs in some cases in which, even when sheets such as black sheets, sheets with low reflectance, and curled sheets are loaded on the sheet loader, the sheet presence detector cannot detect the sheet, and therefore the sheet presence determiner determines that no sheet is loaded on the sheet loader and moves to the paper end operation.

When the paper end operation is performed to lower the sheet loader to the lower limit position, even if a sheet or sheets are actually loaded on the sheet loader, the sheet feeding operation cannot be performed until the sheets are replenished. Accordingly, the stable sheet feeding operation cannot be performed.

By contrast, in the sheet feeding device according to Aspect A, when the sheet presence detector does not detect the sheet and the sheet loader is lowered to the first position after the circuitry has controlled to cause the top of the sheet of the bundle of sheets to be located at the second position, the circuitry causes the sheet presence determiner not to determine that the sheet is absent on the sheet loader.

By causing the sheet presence determiner not to determine that the sheet is absent on the sheet loader, even when the sheet is a black sheet, a sheet having low reflectance, or a curled sheet, an erroneous detection of the end of sheet is restrained from occurring, and therefore such a case that the sheet feeding operation is halted until the sheet is replenished when the sheet is actually loaded on the sheet loader.

Accordingly, a sheet feeding device that can prevent erroneous halt of a stable sheet feeding operation is provided.

Aspect B.

In Aspect A, the sheet feeding device further includes a first position determiner (for example, the first upper face position determiner 201) configured to determine whether the sheet is located at a level of the first position, and a second position determiner (for example, the second upper face position determiner 202) configured to determine whether the sheet is located at a level of the second position.

Aspect C.

In Aspect A or Aspect B, upward movement to lift the sheet loader to lift the sheet from the first position to the second position and downward movement to lower the sheet loader to lower the sheet from the second position to the first position are performed during an initial operation of the sheet feeding device.

According to this configuration, the sheet feeding operation is started from an appropriate position, in other words, a target sheet feeding position. Accordingly, the stable sheet feeding operation can be performed.

Aspect D.

In any one of Aspects A through C, the sheet presence determiner does not determine that the sheet is absent on the sheet loader, before either one of the sheet feeding operation and an initial operation of the sheet feeding device is started.

According to this configuration, the sheet is not erroneously detected as the end of sheet, which is a state in which the sheet is not present on the sheet loader.

Aspect E.

In Aspect B, the first position determiner includes a first sheet detector (for example, the first upper end face sensor 31*a*) configured to detect the sheet and determine whether the sheet is located at the level of the first position based on a detection result obtained by the first sheet detector, and the second position determiner includes a second sheet detector (for example, the second upper end face sensor 31*b*) disposed above the first sheet detector and configured to detect the sheet and determine whether the sheet is located at the level of the second position based on a detection result of the second sheet detector.

According to this configuration, the reflective optical sensor can be easily used as the first sheet detection sensor or the second sheet detection sensor, and a simpler configuration is provided to the first position determiner and the second position determiner.

Aspect F.

In any one of Aspects A through E, the circuitry performs masking to the detection result of the sheet presence detector to cause the sheet presence determiner not to detect that the sheet is absent on the sheet loader.

According to this configuration, a simpler configuration is provided to the sheet presence detector, so that the sheet is not erroneously detected as the end of sheet, which is a state in which the sheet is not present on the sheet loader.

Aspect G.

In Aspect F, the circuitry includes a masking device (for example, the masking processor 204) configured to perform the masking operation and include a latch circuit (for example, the latch 205), and a detection result of the sheet detector that a sheet is loaded is fixed in the latch circuit and when the sheet loader is lowering to lower the sheet from the second position to the first position, whether the sheet is loaded on the sheet loader is determined based on the detection result fixed to the latch circuit.

Aspect H.

In Aspect F, the masking device includes a dummy target detecting body (for example, the dummy detection target sensor 208), and a moving device (for example, the moving device 209) configured to move the dummy target detecting body. When the sheet loader is lowering to lower the sheet from the second position to the first position, the moving device causes the dummy target detecting body to enter within a detecting area of the sheet presence detector.

Aspect I.

In any one of Aspects A through H, in a case in which the sheet loaded on the sheet loader is moved upward from the first position to the second position at the previous initial operation, after a sheet feed job and when the sheet loaded on the sheet loader is lowered to the first position, the circuitry causes the sheet presence determiner not to determine that the sheet is absent on the sheet loader.

According to this configuration, the sheet is not erroneously detected as the end of sheet, which is a state in which the sheet is not present on the sheet loader.

Aspect J.

In Aspect B or Aspect E, the sheet feeding device further includes an air blower (for example, the air blowing device 17) configured to blow air toward an upper end portion of the bundle of sheets loaded on the sheet loader and lift the sheet. The loader elevating device causes the sheet loader to stop moving in the vertical direction and complete the initial operation based on respective detection results of the first position determiner and the second position determiner. As a sheet feeding operation starts and the air blower starts blowing air, the circuitry controls the position of the sheet loader based on a detection result of the second position determiner.

According to this configuration, the following effects can be achieved.

Specifically, in the initial operation, the sheet loader is stopped at the second position, and during the sheet feeding operation, the position of the sheet loader is controlled based on the detection result of the first position detector. By so doing, air is blown at the start of sheet feeding operation, and therefore the sheet loaded on the sheet loader can be floated easily.

Further, during the sheet feeding operation, the position of the sheet loader is controlled based on the detection result of the first position detector. Therefore, even a sheet having low reflectance that cannot be detected as presence of the sheet at the second position can be detected correctly.

Aspect K.

An image forming apparatus (for example, the image forming apparatus 100) includes an image forming device (for example, the image forming units 101Y, 101M, 101C, and 101K) configured to form an image on a sheet (for example, the sheet P) of a bundle of sheets, and the sheet feeding device (for example, the sheet feeding device 200) according to any one of Aspects A through J, configured to feed the sheet separated from the bundle of sheets toward the image forming device.

According to this configuration, an image forming apparatus that can provide the same effect as the sheet feeding device according to any one of Aspects A through J is provided.

Aspect L.

An image forming system (for example, the image forming system 1) includes an image forming apparatus (for example, the image forming apparatus 100) configured to form an image on a sheet (for example, the sheet P) of a bundle of sheets, and the sheet feeding device (for example, the sheet feeding device 200) according to any one of Aspects A through J, configured to feed the sheet separated from the bundle of sheets toward the image forming device.

According to this configuration, an image forming system that can provide the same effect as the sheet feeding device according to any one of Aspects A through J is provided.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device comprising:

a sheet loader on which a bundle of sheets is to be loaded;

a loader elevating device configured to move the sheet loader in a vertical direction;

a sheet presence detector configured to detect whether the bundle of sheets is loaded on the sheet loader; and circuitry configured to determine whether the bundle of sheets is loaded on the sheet loader based on a detection result of the sheet presence detector, and to control movement of the loader elevating device, the circuitry being configured to cause the loader elevating device to lift the sheet loader to a second position that is above a first position in the vertical direction of the sheet loader, in response to a detection result of the sheet presence detector indicating that a sheet is absent on the sheet loader at the first position, the circuitry being configured, in response to causing the loader elevating device to lower the sheet loader from the second position to the first position after the circuitry causes the loader elevating device to lift the sheet loader to the second position, to mask the detection result of the sheet presence detector to prevent a determination that the sheet is absent on the sheet loader.

2. The sheet feeding device according to claim 1, wherein the circuitry includes:

a first position determiner configured to determine whether the sheet is located at a level of the first position; and a second position determiner configured to determine whether the sheet is located at a level of the second position.

3. The sheet feeding device according to claim 2, wherein the circuitry is configured to cause the loader elevating device to lift the sheet loader to lift the sheet from the first position to the second position and to lower the sheet loader to lower the sheet from the second position to the first position during an initial operation of the sheet feeding device.

4. The sheet feeding device according to claim 2, further comprising an air blower configured to blow air toward an upper end portion of the bundle of sheets loaded on the sheet loader to lift the sheet, wherein the loader elevating device is configured to cause the sheet loader to stop moving in the vertical direction and complete an initial operation of the sheet feeding device based on respective detection results of the first position determiner and the second position determiner, and wherein, the circuitry is configured to cause the loader elevating device to move the sheet loader in the vertical direction based on a detection result of the second position determiner, as a sheet feeding operation starts and the air blower starts blowing air.

5. The sheet feeding device according to claim 2, further comprising:

a first sheet detector configured to detect the sheet, and a second sheet detector disposed above the first sheet detector and configured to detect the sheet, wherein the first position determiner is configured to determine whether the sheet is located at the level of the first position based on a detection result of the first sheet detector, and wherein the second position determiner is configured to determine whether the sheet is located at the level of the second position based on a detection result of the second sheet detector.

6. The sheet feeding device according to claim 5, further comprising an air blower configured to blow air toward an upper end portion of the bundle of sheets loaded on the sheet loader and lift the sheet, wherein the loader elevating device is configured to cause the sheet loader to stop moving in the vertical direction and complete an initial operation of the sheet feeding device based on respective detection results of the first position determiner and the second position determiner, and wherein the circuitry is configured to cause the loader elevating device to move the sheet loader in the vertical direction based on a detection result of the second position determiner as a sheet feeding operation starts and the air blower starts blowing air.

7. The sheet feeding device according to claim 1, wherein the circuitry is configured to cause the loader elevating device to lift the sheet loader to lift the sheet from the first position to the second position and to lower the sheet loader to lower the sheet from the second position to the first position during an initial operation of the sheet feeding device.

8. The sheet feeding device according to claim 1, wherein the circuitry is configured not to determine that the sheet is absent on the sheet loader, before either one of a sheet feeding operation and an initial operation of the sheet feeding device is started.

9. The sheet feeding device according to claim 1, wherein the circuitry includes a latch circuit configured to mask the detection result of the sheet presence detector, and wherein, when a detection result of the sheet presence detector that a sheet is loaded on the sheet loader is fixed in the latch circuit and the sheet loader is lowering to lower the sheet from the second position to the first position, the circuitry is configured to determine whether the sheet is loaded on the sheet loader based on the detection result fixed in the latch circuit.

10. The sheet feeding device according to claim 1, further comprising:

a dummy detection target member; and a moving device configured to move the dummy detection target member to mask the sheet presence detector, wherein the moving device is configured to cause the dummy detection target member to enter within a detecting area of the sheet presence detector when the sheet loader is lowering to lower the sheet from the second position to the first position.

11. The sheet feeding device according to claim 1, wherein, in a case in which a sheet loaded on the sheet loader is lifted from the first position to the second position at a previous initial operation, the circuitry is configured not to determine that the sheet is absent on the sheet loader when the sheet loaded on the sheet loader is lowered to the first position after a sheet feed job.

12. An image forming apparatus comprising:

the sheet feeding device according to claim 1, configured to feed a sheet separated from the bundle of sheets; and an image forming device configured to form an image on the sheet fed by the sheet feeding device.

13. An image forming system comprising:

the sheet feeding device according to claim 1, configured to feed the sheet separated from the bundle of sheets; and an image forming apparatus configured to form an image on the sheet fed by the sheet feeding device.

14. A sheet feeding device comprising:

a sheet loader on which a bundle of sheets is to be loaded;

a loader elevating device configured to move the sheet loader in a vertical direction;

a sheet presence detector configured to detect whether the bundle of sheets is loaded on the sheet loader; and circuitry configured to determine whether the bundle of sheets is loaded on the sheet loader based on a detection result of the sheet presence detector, and to control movement of the loader elevating device, the circuitry being configured to cause the loader elevating device to lift the sheet loader to a second position that is above a first position in the vertical direction of the sheet loader, in response to a detection result of the sheet presence detector indicating that a sheet is absent on the sheet loader at the first position, the circuitry being configured not to determine that the sheet is absent on the sheet loader when the circuitry causes the loader elevating device to lower the sheet loader from the second position to the first position after the circuitry causes the loader elevating device to lift the sheet loader to the second position wherein the circuitry includes:

a first position determiner configured to determine whether the sheet is located at a level of the first position; and a second position determiner configured to determine whether the sheet is located at a level of the second position;

wherein the sheet feeding device further includes an air blower configured to blow air toward an upper end portion of the bundle of sheets loaded on the sheet loader to lift the sheet, wherein the loader elevating device is configured to cause the sheet loader to stop moving in the vertical direction and complete an initial operation of the sheet feeding device based on respective detection results of the first position determiner and the second position determiner, and wherein, the circuitry is configured to cause the loader elevating device to move the sheet loader in the vertical direction based on a detection result of the second position determiner, as a sheet feeding operation starts and the air blower starts blowing air.

15. A sheet feeding device comprising:

a sheet loader on which a bundle of sheets is to be loaded;

a loader elevating device configured to move the sheet loader in a vertical direction;

a sheet presence detector configured to detect whether the bundle of sheets is loaded on the sheet loader; and circuitry configured to determine whether the bundle of sheets is loaded on the sheet loader based on a detection result of the sheet presence detector, and to control movement of the loader elevating device, the circuitry being configured to cause the loader elevating device to lift the sheet loader to a second position that is above a first position in the vertical direction of the sheet loader, in response to a detection result of the sheet presence detector indicating that a sheet is absent on the sheet loader at the first position, the circuitry being configured not to determine that the sheet is absent on the sheet loader when the circuitry causes the loader elevating device to lower the sheet loader from the second position to the first position after the circuitry causes the loader elevating device to lift the sheet loader to the second position; and wherein the circuitry includes:

a first position determiner configured to determine whether the sheet is located at a level of the first position; and a second position determiner configured to determine whether the sheet is located at a level of the second position;

wherein the sheet feeding device further includes a first sheet detector configured to detect the sheet, and a second sheet detector disposed above the first sheet detector and configured to detect the sheet, wherein the first position determiner is configured to determine whether the sheet is located at the level of the first position based on a detection result of the first sheet detector, and wherein the second position determiner is configured to determine whether the sheet is located at the level of the second position based on a detection result of the second sheet detector.

16. The sheet feeding device according to claim 15, further comprising an air blower configured to blow air toward an upper end portion of the bundle of sheets loaded on the sheet loader and lift the sheet, wherein the loader elevating device is configured to cause the sheet loader to stop moving in the vertical direction and complete an initial operation of the sheet feeding device based on respective detection results of the first position determiner and the second position determiner, and wherein the circuitry is configured to cause the loader elevating device to move the sheet loader in the vertical direction based on a detection result of the second position determiner as a sheet feeding operation starts and the air blower starts blowing air.

* * * * *